United States Patent [19]

Furutachi et al.

[11] Patent Number: 4,595,650

[45] Date of Patent: Jun. 17, 1986

[54] COLOR PHOTOGRAPHIC LIGHT-SENSITIVE MATERIAL

[75] Inventors: Nobuo Furutachi; Masakazu Morigaki; Takeshi Hirose, all of Kanagawa, Japan

[73] Assignee: Fuji Photo Film Co., Ltd., Kanagawa, Japan

[21] Appl. No.: 632,738

[22] Filed: Jul. 20, 1984

[30] Foreign Application Priority Data

Jul. 20, 1983 [JP] Japan ..... 58-132134

[51] Int. Cl.[4] ..... G03C 7/16

[52] U.S. Cl. ..... 430/387; 430/505; 430/555; 430/558

[58] Field of Search ..... 430/387, 392, 555, 558, 430/505

[56] References Cited

U.S. PATENT DOCUMENTS

| | | | |
|---|---|---|---|
| 4,351,897 | 9/1982 | Aoki et al. | 430/555 |
| 4,383,027 | 5/1983 | Ishikawa et al. | 430/372 |
| 4,385,111 | 5/1983 | Nakamura et al. | 430/555 |
| 4,413,054 | 11/1983 | Mitsui et al. | 430/505 |
| 4,483,918 | 11/1984 | Sakai et al. | 430/372 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material is described, comprising a support having coated thereon at least one silver halide emulsion layer, the color photographic light-sensitive material having a photographic layer containing at least one kind of magenta coupler of 5-pyrazolone type having an arylthio group at the coupling position thereof, the arylthio group having an alkoxy group or an aryloxy group at the ortho position to the sulfur atom thereof and the alkoxy group and the aryloxy group being substituted with a cyano group, a halogen atom, a sulfonyl group, a sulfinyl group, a phosphonyl group, or an group, wherein A represents a chemical bond, an alkylene group, an arylene group, an oxygen atom, a sulfur atom, or an imino group; and B represents a hydroxy group, an alkoxy group, an aryloxy group, a hydrogen atom, an alkyl group, an aryl group, a heterocyclic group, an acyclic amino group, or a hydrazino group.

The silver halide color photographic light-sensitive material containing the 2-equivalent magenta coupler has an excellent color forming property even when it is processed in a color developing solution containing a salt of alkaline earth metal, exhibits photographic properties which are not influenced by variations in the pH of the color developing solution, and provides a magenta color image having a good light fastness. A method of forming a color image using the silver halide color photographic light-sensitive material is also described.

17 Claims, No Drawings

COLOR PHOTOGRAPHIC LIGHT-SENSITIVE MATERIAL

FIELD OF THE INVENTION

The present invention relates to a color photographic light-sensitive material, and more particularly to a color photographic light-sensitive material wherein the dye forming efficiency in the color development step is high, photographic properties are not influenced by variations in the pH of the color development bath, and the color images are fast to heat or light.

BACKGROUND OF THE INVENTION

Various pyrazolone derivatives have been known as magenta color image-forming couplers (referred to hereinafter simply as "magenta couplers"). However, these pyrazolone derivatives generally have low color forming efficiency (ratio of conversion of the coupler into a dye) when contained in photographic light-sensitive materials, and so-called 4-equivalent couplers, in which the coupling active position is not substituted, usually form only about ½ mol of dye per mol of the coupler.

To improve color forming efficiency, so-called 2-equivalent magenta couplers have been known, in which a substituent is introduced into the coupling active position of a pyrazolone type magenta coupler, and the substituent splits off in the color development step. Examples of such couplers are disclosed, for instance, in U.S. Pat. Nos. 3,311,476, 3,419,391, 3,617,291, 3,926,631, etc. Further, magenta couplers in which a substituent is connected to the coupling active position through a sulfur atom are described in U.S. Pat. No. 3,214,437 (a thiocyano group), U.S. Pat. No. 4,032,346 (an acylthio group or a thioacylthio group), U.S. Pat. Nos. 3,227,554 and 3,701,783 and Japanese Patent Publication No. 34044/78 (an arylthio group or a heterocyclic thio group), and West German Patent Application (OLS) No. 2,944,601 (an alkylthio group).

It has been found that when couplers having an arylthio group at the coupling active position among the magenta couplers described in U.S. Pat. Nos. 3,227,554 and 3,701,783 are used in a color photographic light-sensitive material and color images are formed, the light fastness of the color images does not completely satisfy the desired ever-advancing improvement in the properties of the color photographic light-sensitive materials.

Also, it has been found that when magenta couplers which release an arylthio group as described in Japanese Patent Publication No. 34044/78 are used in a color photographic light-sensitive material and color images are formed, the light fastness of the color images is insufficient.

Magenta couplers which release an arylthio group as described in Japanese Patent Application (OPI) No. 35858/82 (corresponding to U.S. Pat. No. 4,351,897) (the term "OPI" as used herein refers to a "published unexamined Japanese patent application") overcome these known defects described above.

However, these known magenta couplers having an arylthio group as a splitting-off group as described above are disadvantageous in that the color forming property thereof is decreased when photographic light-sensitive materials containing such magenta couplers are processed in a color developing solution containing a salt of alkaline earth metal, such as calcium or magnesium. This can be a fatal defect where the processing solution is prepared using water containing a large amount of a salt of alkaline earth metal, that is, hard water. In fact, it is rarely the case that soft water can be used at color photographic processing laboratories in most parts of the world, and hard water is thus employed as the base water for processing solutions in most cases. For this reason color photographic light-sensitive materials containing these heretofore known magenta couplers having an arylthio group as a splitting-off group can be subjected to development processing only at specific color laboratories wherein hard water is not used, even though they do have several desirable properties.

SUMMARY OF THE INVENTION

Therefore, an object of the present invention is to provide a color photographic light-sensitive material containing a novel 2-equivalent magenta coupler which has an excellent color forming property even when it is processed in a color developing solution containing a salt of alkaline earth metal.

Another object of the present invention is to provide a color photographic light-sensitive material which forms color images having a good light-fastness.

Still another object of the present invention is to provide a color photographic light-sensitive material in which photographic properties are less influenced by variations in the pH of the color developing solution.

A further object of the present invention is to provide a color photographic light-sensitive material containing a low cost 2-equivalent magenta coupler by a simple production process.

A still further object of the present invention is to provide a low cost color photographic light-sensitive material having reduced coupler content and reduced silver halide content.

Other objects of the present invention will become apparent from the following detailed description and examples.

The above-described objects of the present invention can be attained by a silver halide color photographic light-sensitive material comprising a support having coated thereon at least one silver halide emulsion layer, the color photographic light-sensitive material having a photographic layer containing at least one kind of magenta coupler of 5-pyrazolone type having an arylthio group at the coupling position thereof, the arylthio group having an alkoxy group or an aryloxy group at the ortho position to the sulfur atom thereof and the alkoxy group and the aryloxy group being substituted with a cyano group, a halogen atom, a sulfonyl group, a sulfinyl group, a phosphonyl group, or an $$-A-\underset{\underset{O}{\|}}{C}-B$$

group, wherein A represents a chemical bond, an alkylene group (which may be saturated or unsaturated), an arylene group, an oxygen atom, a sulfur atom, or an imino group; and B represents a hydroxy group, an alkoxy group, an aryloxy group, a hydrogen atom, an alkyl group, an aryl group, a heterocyclic group, an acyclic amino group, or a hydrazino group; or wherein A and B are bonded to each other to form a ring together with

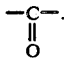

DETAILED DESCRIPTION OF THE INVENTION

The magenta couplers which can be used in the color photographic light-sensitive material of the present invention are novel couplers belonging to a group of 2-equivalent magenta couplers having an arylthio group at the coupling active position of a pyrazolone.

The magenta couplers used in the color photographic light-sensitive material of the present invention not only have superior properties such as the magenta couplers having an arylthio group as a splitting-off group as described in Japanese Patent Application (OPI) No. 35858/82 have, but also have the very significant feature that the color forming property is not reduced even when they are processed in processing solutions using hard water as the base water. This property could not at all be expected from the heretofore known couplers having an arylthio group as a splitting-off group.

Magenta couplers used according to the present invention are preferably represented by formula (I)

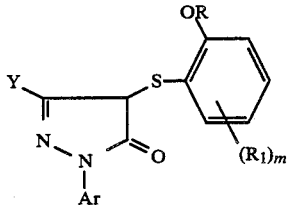

(I)

wherein Ar represents a phenyl group substituted with at least one halogen atom, an alkyl group, an alkoxy group, an alkoxycarbonyl group, or a cyano group; R represents an alkyl group or an aryl group each being substituted with a cyano group, a halogen atom, a sulfonyl group, a sulfinyl group, a phosphonyl group, or an

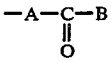

group (wherein A and B each has the same meaning as defined above); $R_1$ represents a hydrogen atom, a halogen atom, a hydroxy group, an alkyl group, an alkoxy group, an aryl group, an amino group, an acylamino group, an alkylureido group, an alkoxycarbonylamino group, an imido group, a sulfonamido group, a sulfamoyl group, a sulfamoylamino group, a nitro group, an alkoxycarbonyl group, a carbamoyl group, an acyl group, a cyano group or an alkylthio group; Y represents an acylamino group or an anilino group; m represents an integer of from 1 to 4 and when m is 2 or more, the $R_1$'s may be the same or different.

Further, the couplers include bis type couplers wherein R or $R_1$ is connected to another coupler group.

An amount of coupler to be added according to the present invention is from $2\times10^{-3}$ mol to $5\times10^{-1}$ mol, and preferably from $1\times10^{-2}$ to $5\times10^{-1}$ mol, per mol of silver.

Of the compounds represented by formula (I), more preferred compounds are those represented by formula (II)

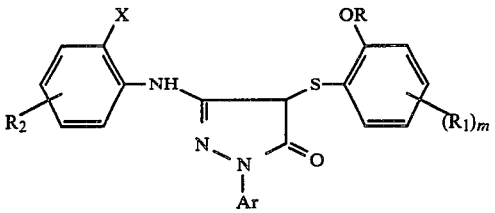

(II)

wherein R, $R_1$, m, and Ar each has the same meaning as defined for formula (I); X represents a halogen atom or an alkoxy group; and $R_2$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, or a trichloromethyl group.

Magenta couplers represented by formula (II) are described in more detail below.

In formula (II), Ar is a substituted phenyl group. Substituents for the phenyl group include a halogen atom (for example, a chlorine atom, a bromine atom, a fluorine atom, etc.), an alkyl group having from 1 to 22 carbon atoms (for example, a methyl group, an ethyl group, a tetradecyl group, a tert-butyl group, etc.), an alkoxy group having from 1 to 22 carbon atoms (for example, a methoxy group, an ethoxy group, an octyloxy group, a dodecyloxy group, etc.), an alkoxycarbonyl group having from 2 to 23 carbon atoms (for example, a methoxycarbonyl group, an ethoxycarbonyl group, a tetradecyloxycarbonyl group, etc.), or a cyano group.

X in formula (II) represents a halogen atom (for example, a chlorine atom, a bromine atom, a fluorine atom, etc.) or an alkoxy group having from 1 to 22 carbon atoms (for example, a methoxy group, an octyloxy group, a dodecyloxy group, etc.).

$R_2$ in formula (II) represents a hydrogen atom, a halogen atom (for example, a chlorine atom, a bromine atom, a fluorine atom, etc.), an alkyl group (including a straight chain or branched chain alkyl group, an aralkyl group, an alkenyl group, a cycloalkyl group, and a cycloalkenyl group, for example, a tert-butyl group, a tert-octyl group, a tetradecyl group, a benzyl group, an allyl group, a cyclopentyl group, a cyclohexenyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a tetradecanamido group, an α-(2,4-di-tert-amylphenoxy)acetamido group, an α-(2,4-di-tert-amylphenoxy)butyramido group, an α-(3-pentadecylphenoxy)hexanamido group, an α-(4-hydroxy-3-tert-butylphenoxy)tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (for example, an N-methylsulfamoyl group, an N-hexadecylsulfamoyl group, an N-[3-(dodecyloxy)propyl]-sulfamoyl group, an N-[4-(2,4-di-tert-amylphenoxy)-butyl]-sulfamoyl group, an N-methyl-N-tetradecylsulfamoyl group, etc.), a carbamoyl group (for example, an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, an octyloxysulfonyl group, a tetradecyloxysulfonyl group, etc.), an aryloxysulfonyl group (for example, a phenoxysulfonyl group, a 2,4-di-tert-amylphenoxysulfonyl group, etc.), an alkanesulfonyl group (for example, a methanesulfonyl group, an octanesulfonyl group, a 2-ethylhexanesulfonyl group, a hexadecanesulfonyl group, etc.), an arylsulfonyl group (for example, a benzenesulfonyl group, a 4-nonylbenzenesulfonyl group, etc.), an alkylthio group (for example, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group, or a trichloromethyl group. In the above-described substituents, the alkyl moieties thereof preferably have from 1 to 36 carbon atoms, and the aryl moieties thereof preferably have from 6 to 38 carbon atoms.

The halogen atom, the alkyl group, the alkoxy group, the acylamino group, the alkylureido group, the alkoxycarbonylamino group, the imido group (same as diacylamino group), the sulfonamido group, the sulfamoyl group, the alkoxycarbonyl group, the carbamoyl group and the alkylthio group represented by $R_1$ each has the same meaning as defined for $R_2$. In addition to these groups, $R_1$ in formula (II) can represent a hydrogen atom, a hydroxy group, an aryl group (for example, a phenyl group, an $\alpha$- or $\beta$-naphthyl group, a 2-chlorophenyl group, a 4-acetamidophenyl group, a 4-tert-butylphenyl group, a 4-cyanophenyl group, etc.), an amino group (including an N-alkylamino group, an N,N-dialkylamino group and an anilino group; examples of the N-alkylamino group including an N-butylamino group, an N-(2-methoxyethyl)amino group, an N-(2-methanesulfonylethyl)amino group, an N-(3-acetamidopropyl)amino group, etc.; examples of the N,N-dialkylamino group including an N,N-dibutylamino group, an N,N-dihexylamino group, an N,N-bis(2-ethylhexyl)amino group, an N,N-bis(2-hexanesulfonylethyl)amino group, an N-ethyl-N-dodecylamino group, an N,N-bis(3-phenoxypropyl)amino group, an N-ethyl-N-[2-(2,4-di-tert-amylphenoxy)ethyl]amino group, an N,N-bis{2-[(4-tert-butylphenoxy)acetamido]ethyl}amino group, etc.; examples of the anilino group including a phenylamino group, a 4-methoxyphenylamino group, an N-ethyl-N-phenylamino group, a 2,4-di-tert-amylphenylamino group, a 3-methanesulfonamidophenylamino group, a 2-chlorophenylamino group, etc.), a sulfamoylamino group (for example, an N,N-dibutylsulfamoylamino group, an N-ethyl-N-dodecylsulfamoylamino group, an N-ethyl-N-anilinosulfamoylamino group, an N,N-bis(2-butanesulfonylethyl)sulfamoylamino group, etc.), a nitro group, an acyl group (for example, an acetyl group, a benzoyl group, a hexanoyl group, a 2,4-di-tert-butylbenzoyl group, a 2-hydroxybenzoyl group, a decyloxyacetyl group, etc.) or a cyano group.

R in formula (II) represents an alkyl group or an aryl group each having a substituent selected from a cyano group, a halogen atom, a sulfonyl group, a sulfinyl group, a phosphonyl group, and an

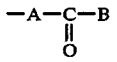

group (wherein A and B each has the same meaning as defined above), and preferably an alkyl group or an aryl group each having a substituent selected from

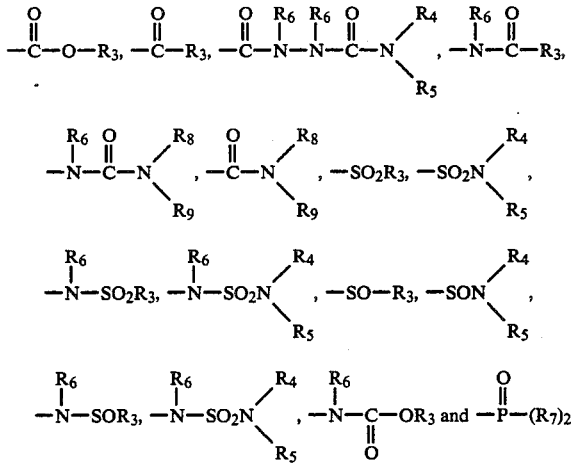

wherein $R_3$ represents a hydrogen atom, an alkyl group, an aryl group or a heterocyclic group; $R_4$ and $R_5$ independently represent a hydrogen atom, an alkyl group, an aryl group or a heterocyclic group, or may be bonded to each other to form a 5-membered, 6-membered, or 7-membered nitrogen-containing heterocyclic ring; $R_6$ represents a hydrogen atom or an alkyl group; $R_7$ represents an alkyl group, an alkoxy group, an aryl group, or an aryloxy group; and $R_8$ and $R_9$ independently represent a hydrogen atom, an alkyl group, an aryl group, or a heterocyclic group. The alkyl group and the aryl group represented by $R_3$ to $R_9$ may be substituted with a substituent as defined for $R_1$ and $R_2$.

Particularly preferred groups for R include an alkyl group having a substituent selected from a carbonyl group, a sulfonyl group, and a phosphonyl group, as described above.

Specific examples of the magenta couplers according to the present invention are set forth below, but the present invention is not to be construed as being limited to these compounds.
1.
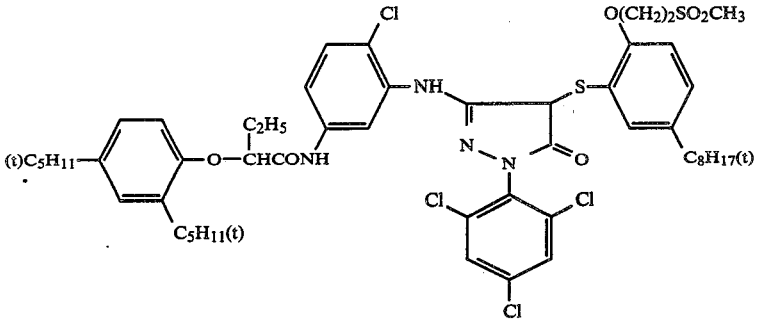
2.
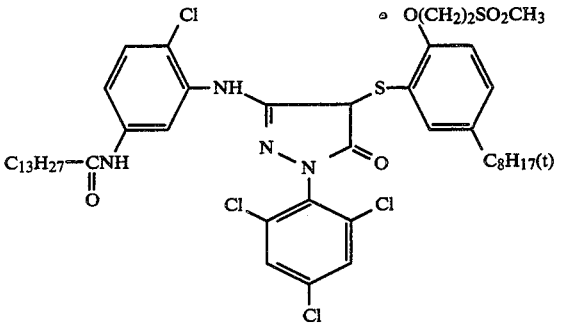
3.
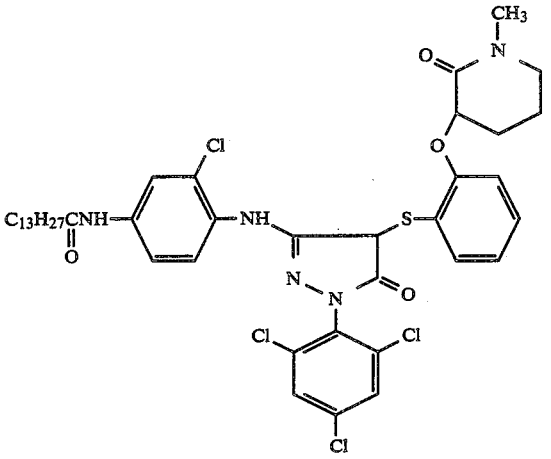
4.
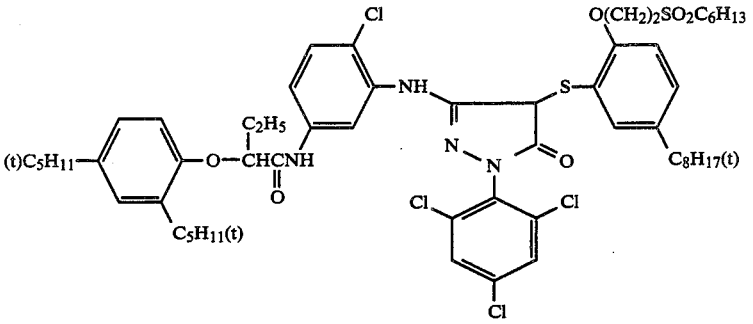
5.
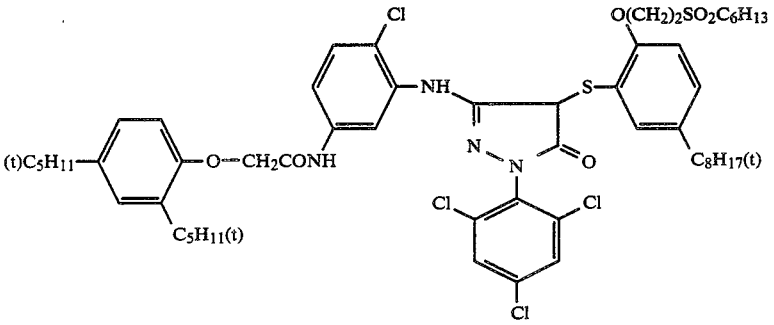

-continued
6.
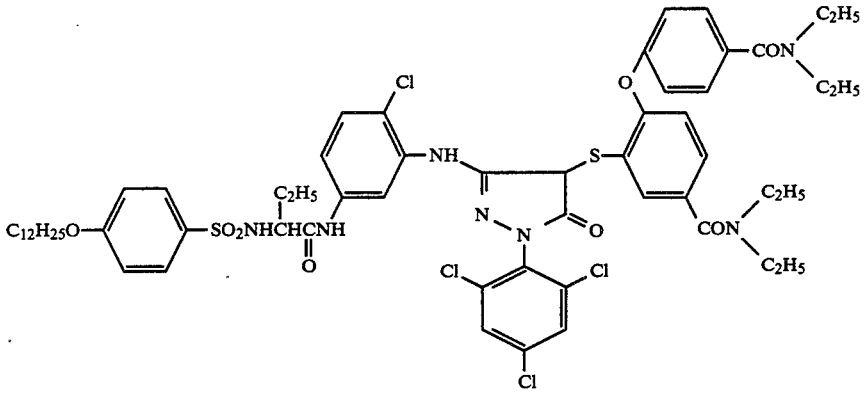
7.
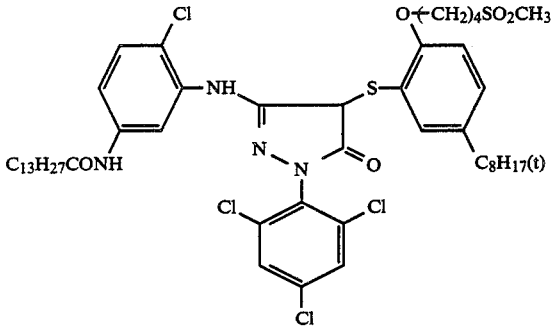
8.
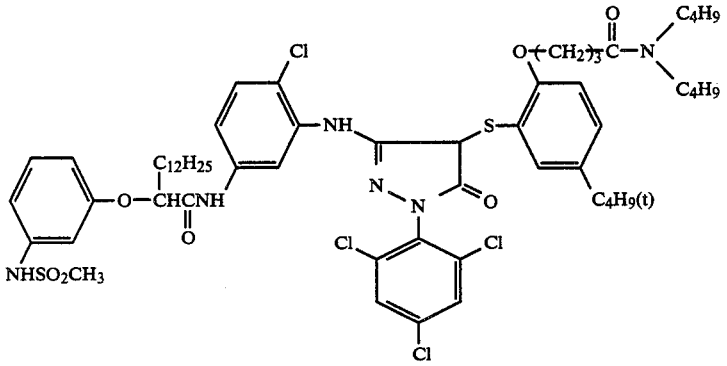
9.
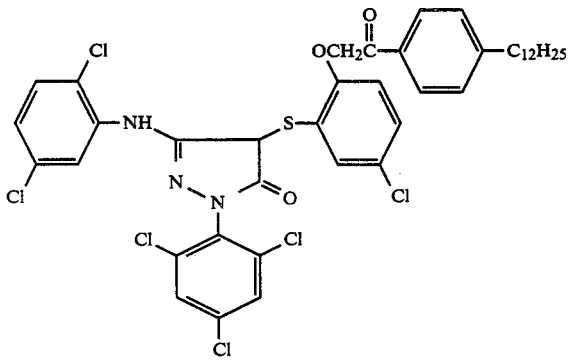

-continued
10.
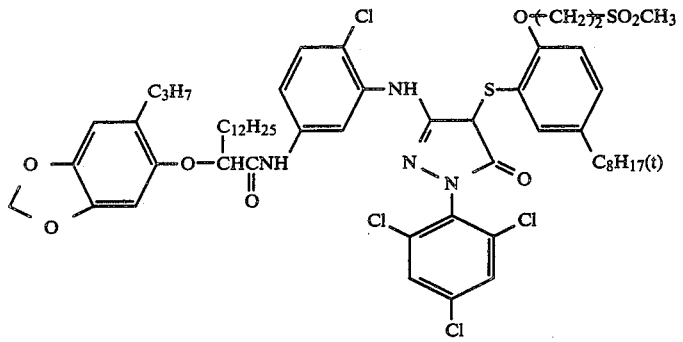
11.
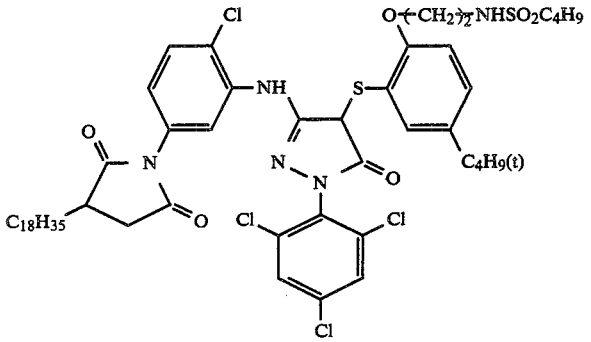
12.
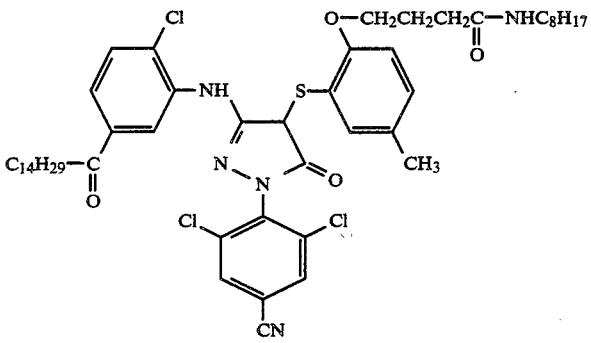
13.
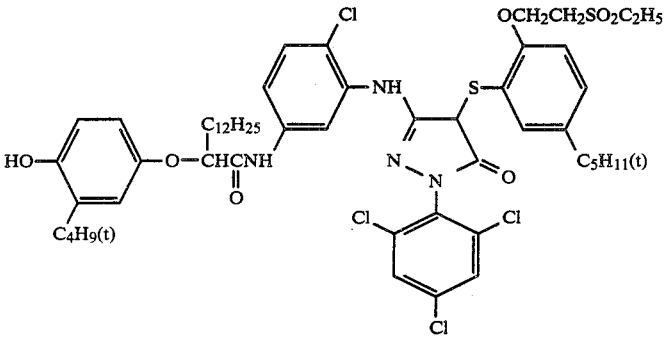

-continued
14.
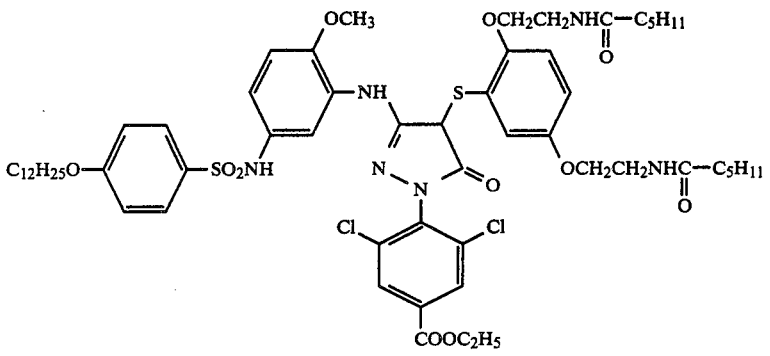
15.
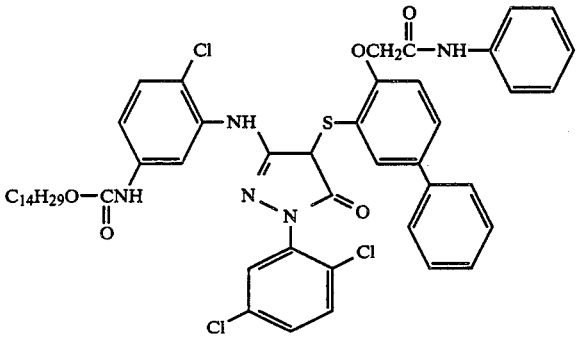
16.
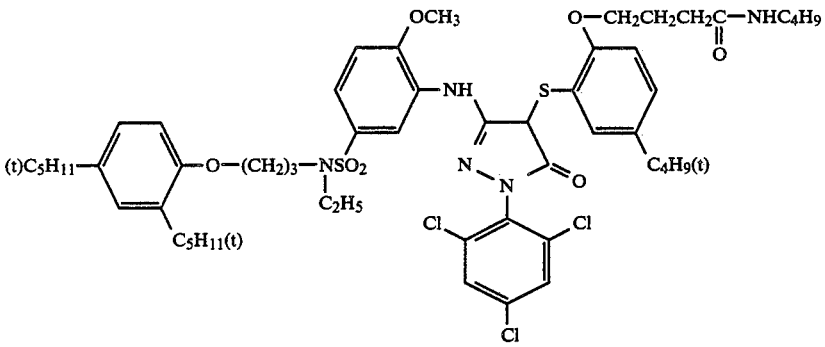
17.
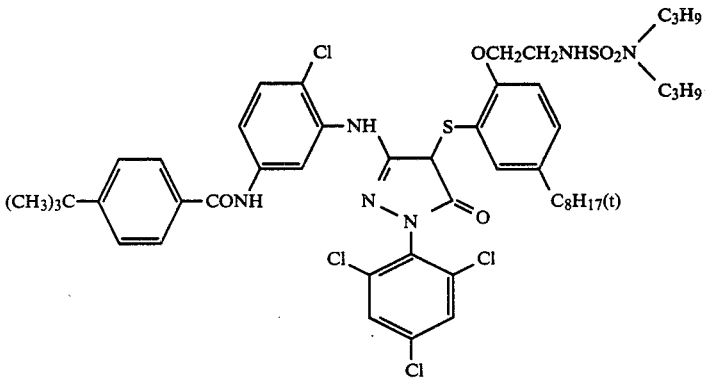

-continued
18.
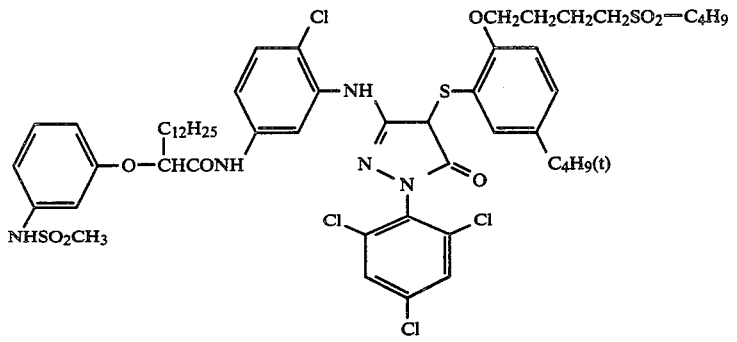
19.
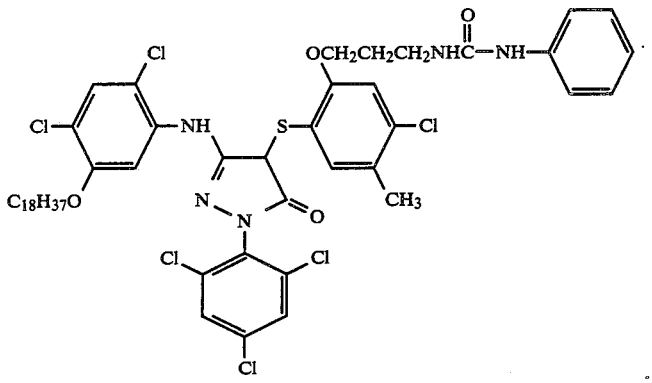
20.
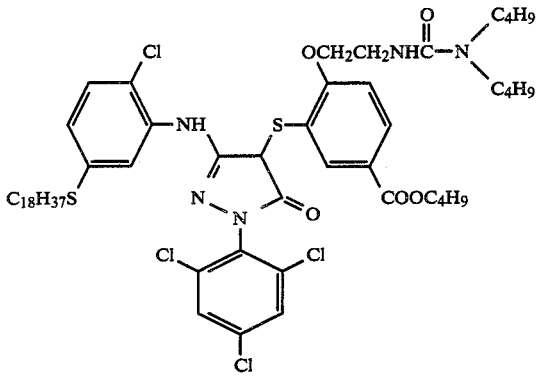
21.
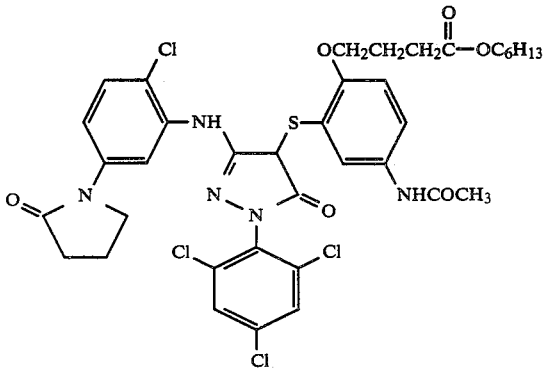

-continued
22.
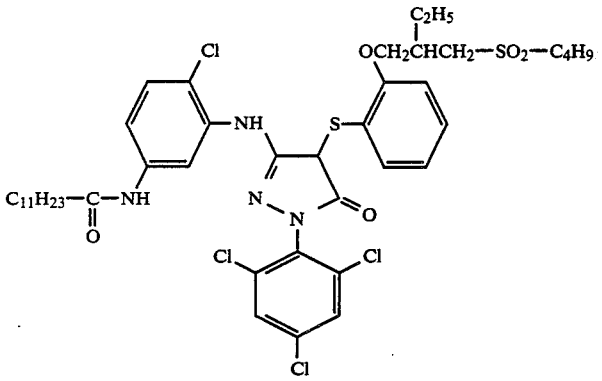
23.
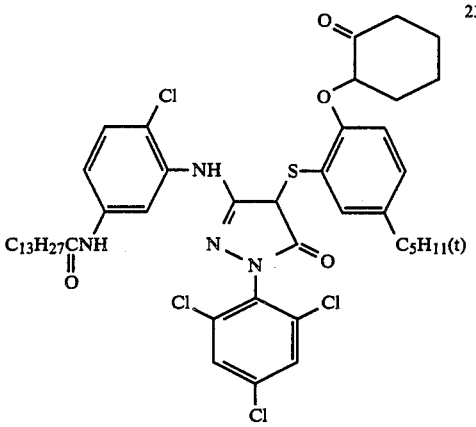
24.
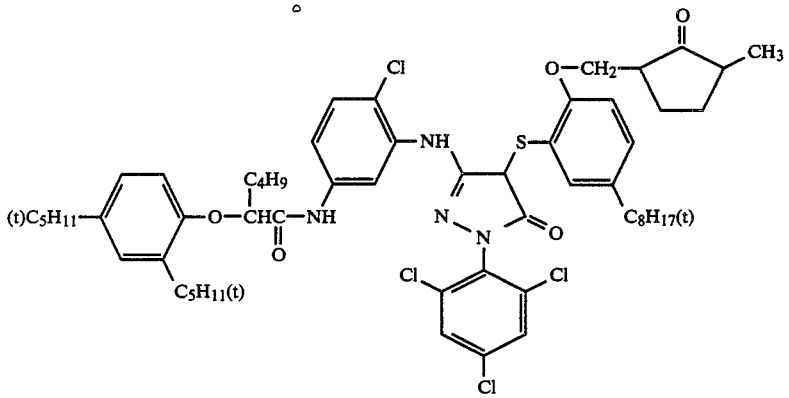
25.
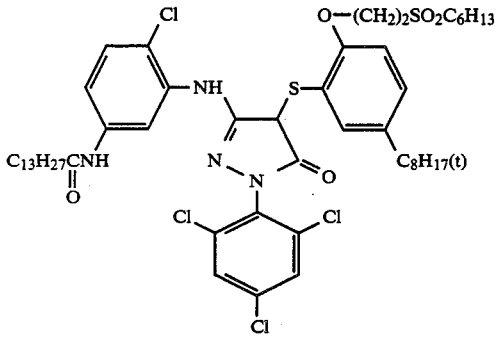
26.
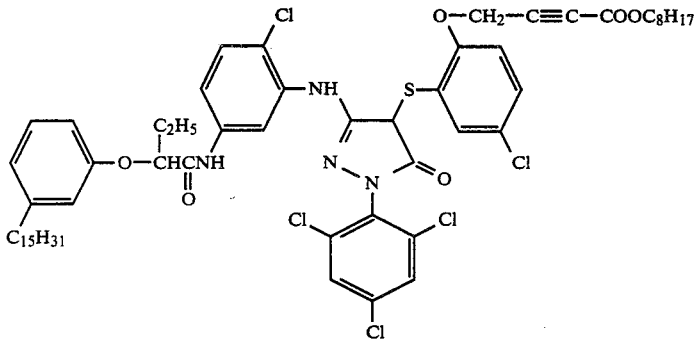

-continued
27.
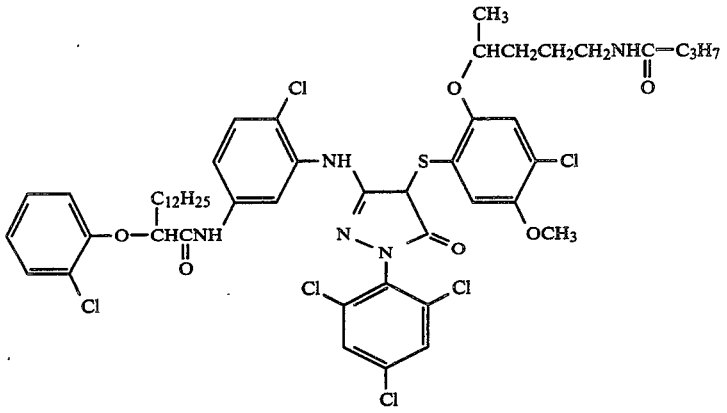
28.
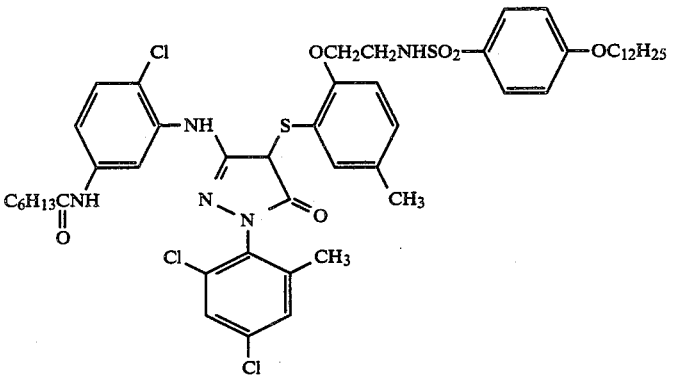
29.
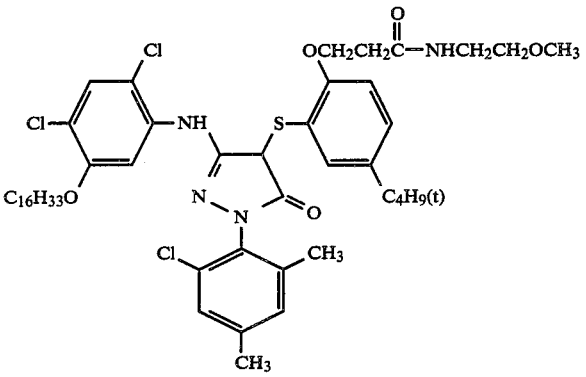
30.
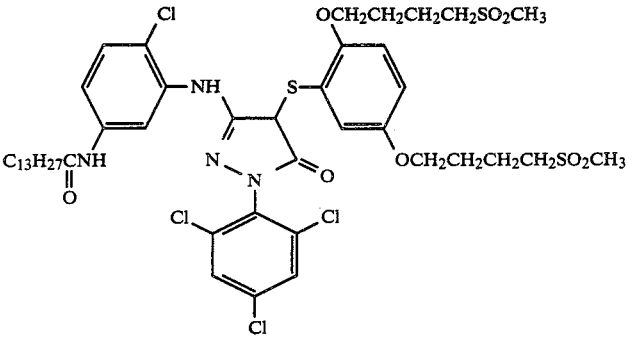

-continued
31.
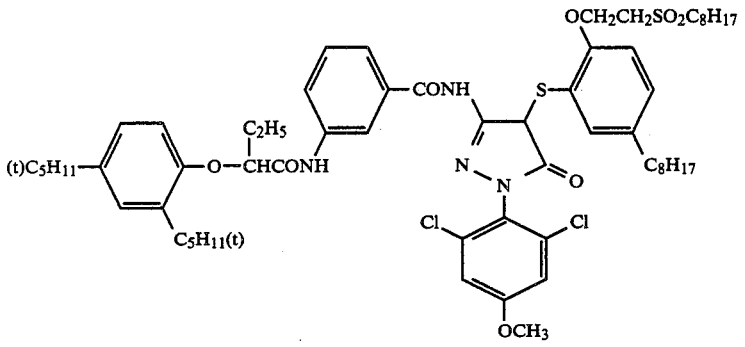
32.
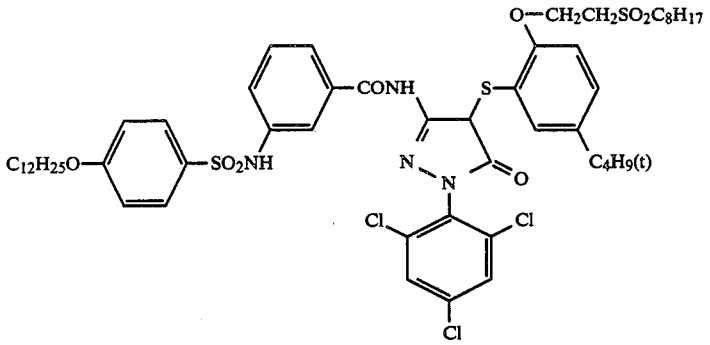
33.
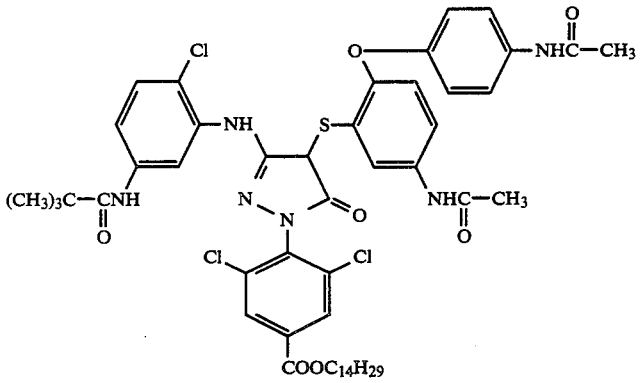
34.
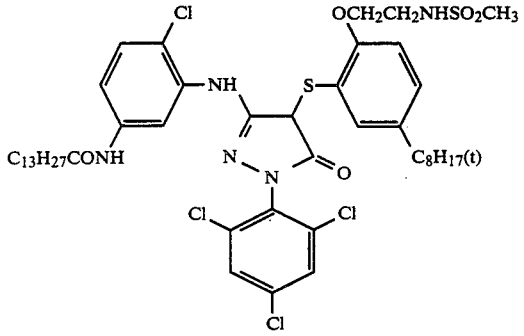

-continued
35.
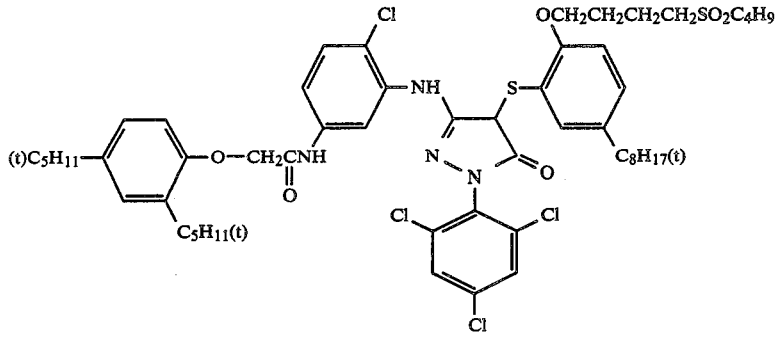
36.
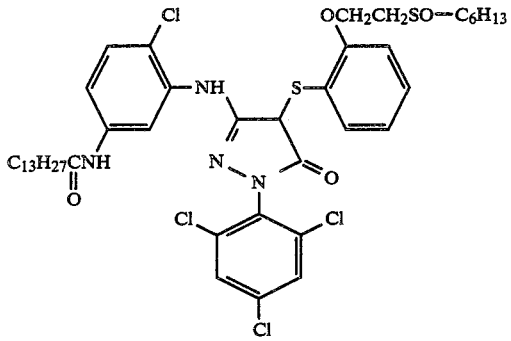
37.
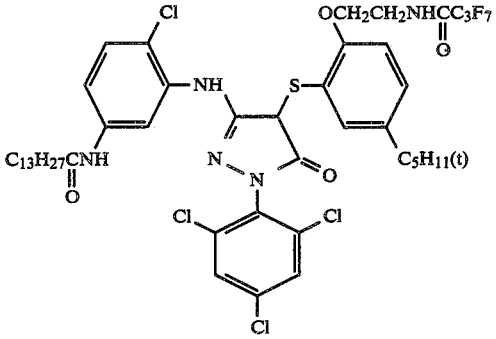
38.
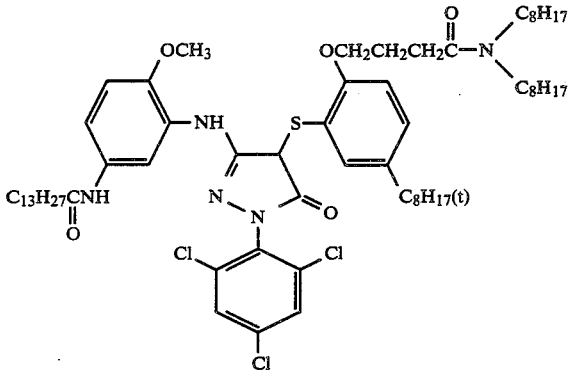
39.
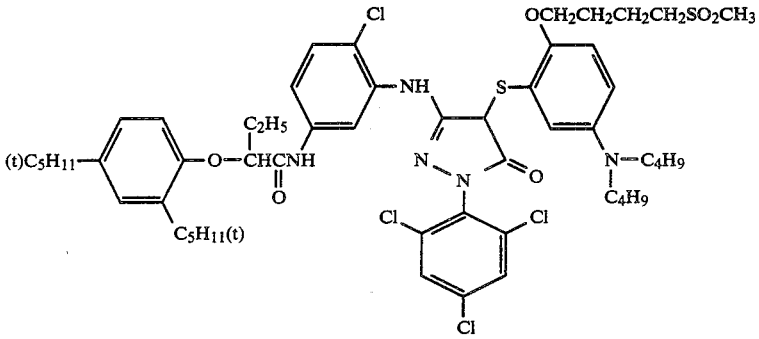

-continued
40.
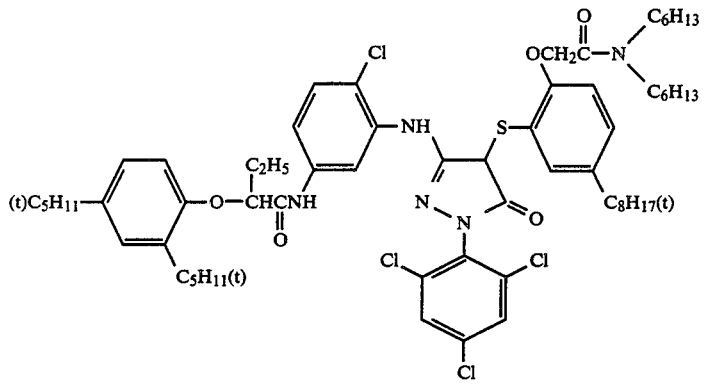
41.
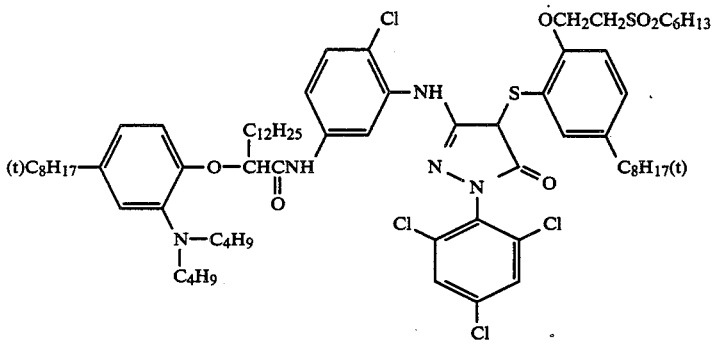
42.
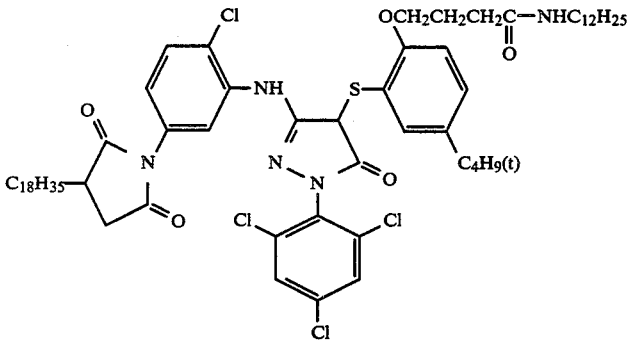
43.
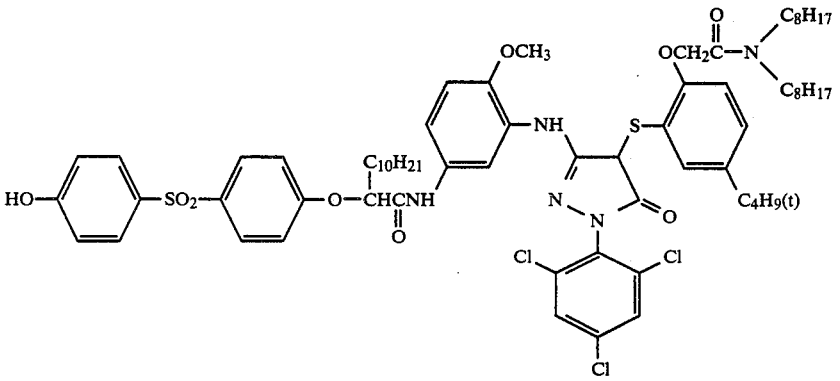

-continued
44.
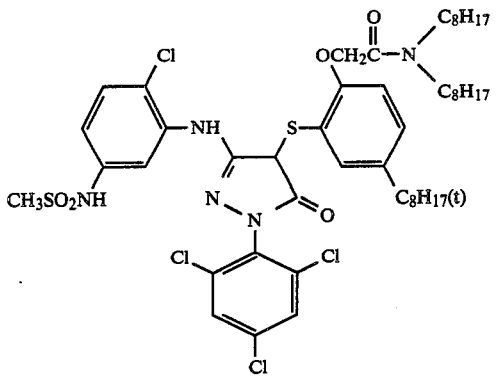
45.
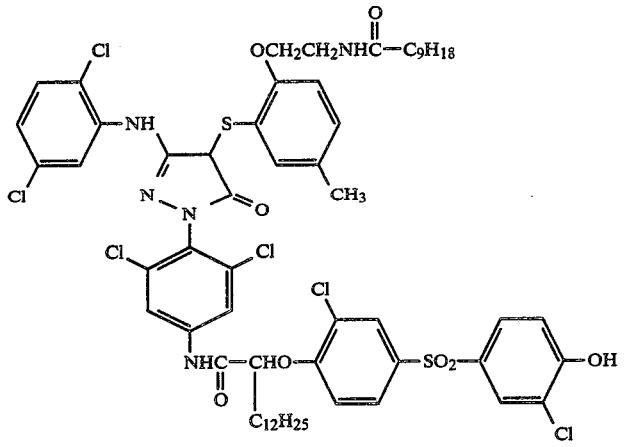
46.
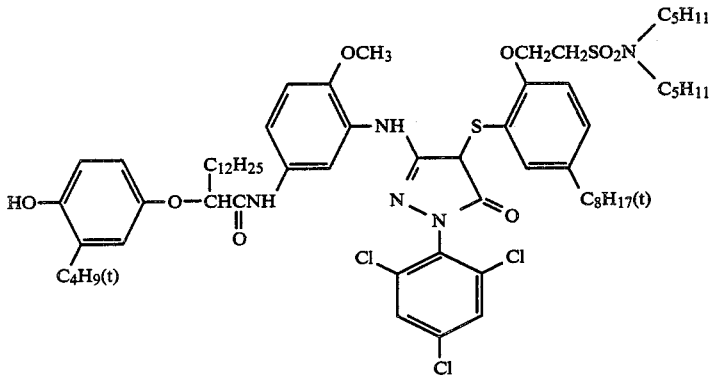
47.
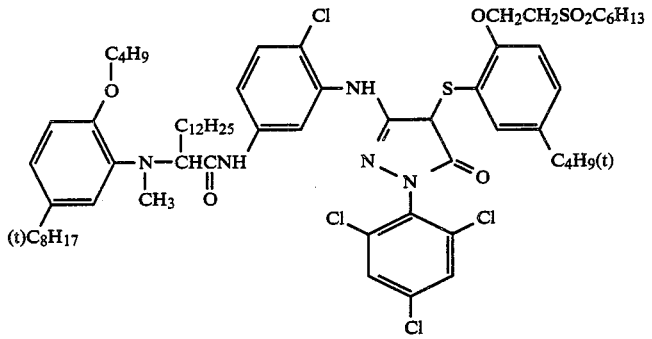
48.
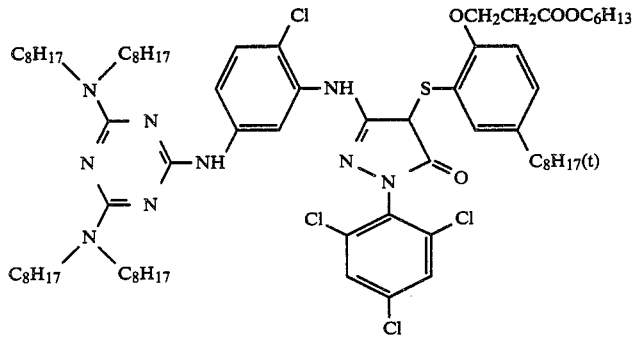

-continued

49.

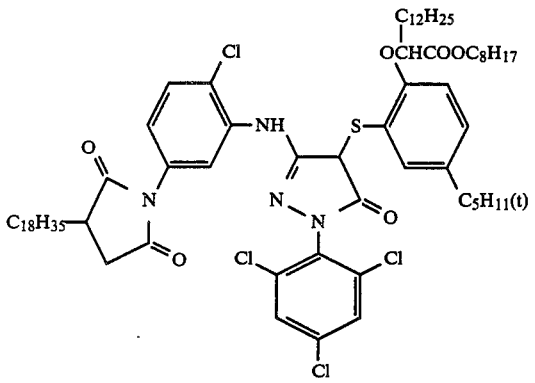

50.

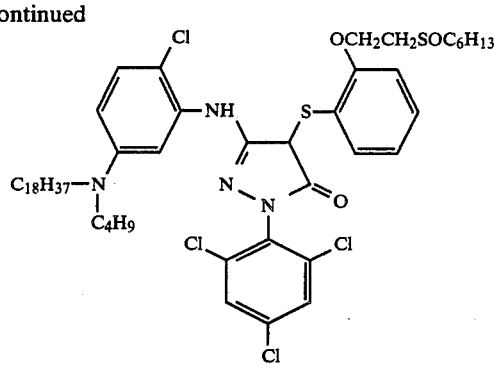

51.

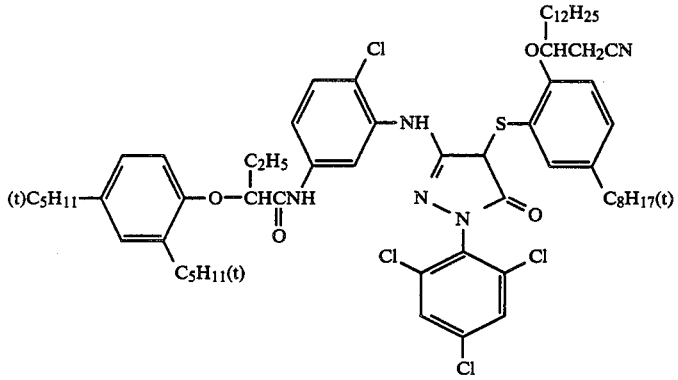

52.

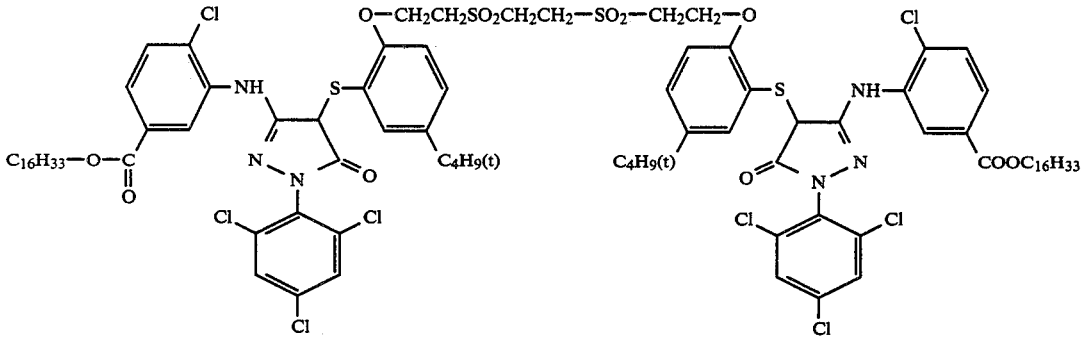

53.

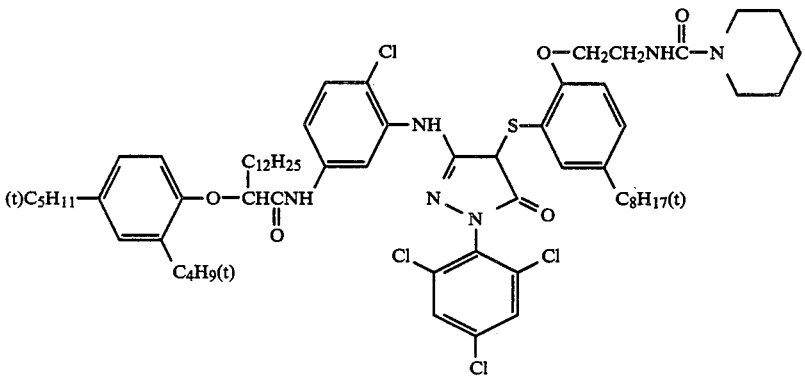

The magenta couplers according to the present invention can be synthesized by a combination of the methods as described in Japanese Patent Application (OPI) No. 35858/82 (corresponding to U.S. Pat. No. 4,351,897).

Specific examples of synthesizing magenta couplers according to the present invention are set forth below.

SYNTHESIS EXAMPLE 1

Synthesis of Coupler (1)

Coupler (1) was synthesized along the reaction scheme as illustrated below.

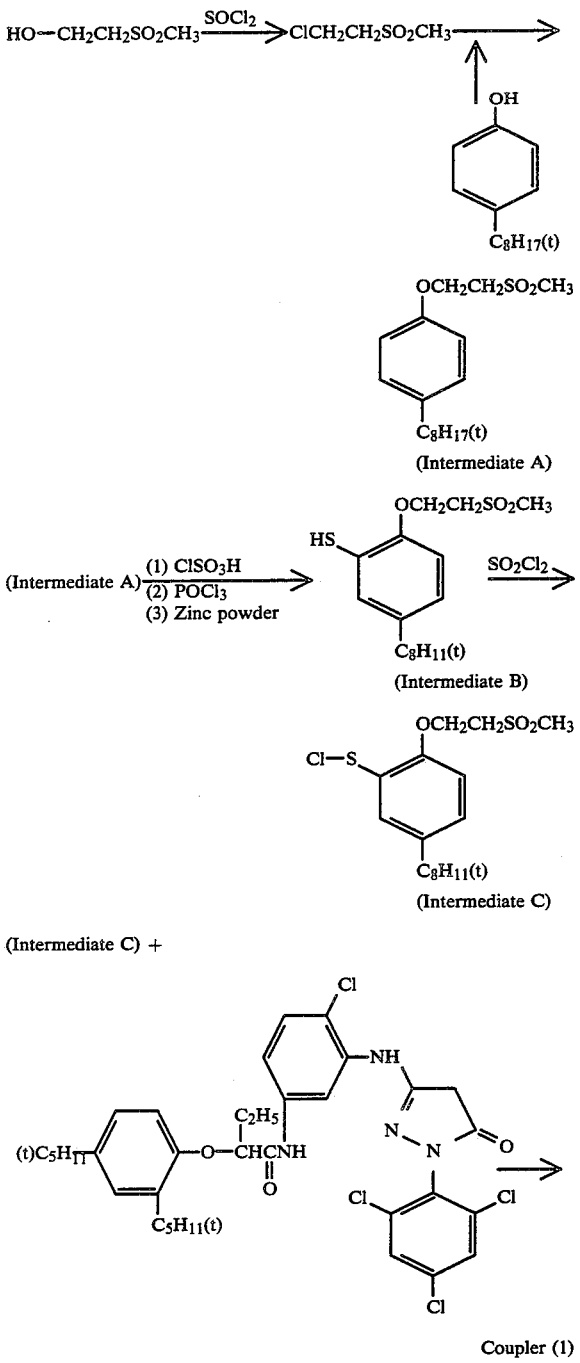

Step (1): Synthesis of Intermediate A 206 g (1 mol) of tert-octylphenol, 276 g (2 mol) of anhydrous potassium carbonate, 60 ml of polyethylene glycol 400 were added to 600 ml of acetonitrile and the mixture was heated to 50° C. with stirring. To the mixture 213.8 g (1.5 mol) of 2-methanesulfonylethyl chloride (synthesized from 2-methanesulfonylethanol and thionyl chloride using a known method as illustrated in the reaction scheme above) was dropwise added over a period of 30 minutes and the mixture was further refluxed by heating for 5 hours. After the completion of the reaction, the reaction mixture was cooled, the inorganic solids were removed by filtration, and the filtrate was concentrated under reduced pressure. The residual oily product thus-obtained was crystallized from 500 ml of a solvent mixture of methanol and water (4:1 by volume) to obtain 217.5 g (yield: 69.7%) of Intermediate A as colorless crystals having a melting point of 68° to 71° C.

Step (2): Synthesis of Intermediate B 217.5 g of Intermediate A described above was dissolved in 550 ml of methylene chloride and the solution was cooled to 5° C. To the mixture 61.5 ml of anhydrous chlorosulfonic acid was added dropwise and the mixture was stirred while maintaining the reaction temperature at 10° C.±3° C. (the period for the dropwise addition was 1 hour). To the mixture 120 ml of acetonitrile, 300 ml of dimethylacetamide, and 128 ml of phosphorus oxychloride were added in order, and the mixture was stirred at 40° C. for 1 hour. After the completion of the reaction, the reaction mixture was poured into a mixture of 110 ml of concentrated sulfuric acid and 500 g of ice (at 0° C.), and stirred while maintaining the temperature below 10° C. To the mixture 175 g of zinc powder was added, divided into several parts, while controlling the temperature below 40° C. After the completion of the addition of all zinc powder, the mixture was heated at a temperature of 70° to 75° C. and stirred with heating for 1.5 hours. Then, the mixture was cooled, an excess zinc powder was removed by filtration, to the reaction mixture 1,000 ml of ethyl acetate was added for extraction, followed by washing repeatedly with water. The ethyl acetate layer was dried with anhydrous sodium sulfate and, then, the solvent was distilled off. The residual oily product was almost pure Intermediate B (205 g).

Step (3): Synthesis of Intermediate C and Coupler (1)

17.2 g (0.05 mol) of Intermediate B was dissolved in 20 ml of methylene chloride, to the solution was added 4.0 ml (0.05 mol) of sulfonyl chloride while stirring at room temperature, and the mixture was further stirred for 30 minutes. The reaction solution was concentrated under reduced pressure to obtain Intermediate C as a red-orange colored oily product.

33.2 g (0.047 mol) of 1-(2,4,6-trichlorophenyl)-3-{2-chloro-5-[α-(2,4-di-tert-amylphenoxy)-butyramido]anilino}-5-pyrazolone was dissolved in 100 ml of dimethylformamide and the solution was heated at 40° C. with stirring. To the solution the above-described Intermediate C was rapidly added and the mixture was heated at 50° C. for 2 hours with stirring. 200 ml of ethyl acetate was added to the mixture, extracted and washed repeatedly with water. The ethyl acetate layer was dried with anhydrous potassium carbonate and concentrated to obtain an oily residue. The oily residue was crystallized from a solvent mixture of hexane and benzene (100 ml:50 ml) to obtain 28 g (yield: 56.9%) of Coupler (1) as colorless crystals having a melting point of 133° to 136° C.

Elemental Analysis: Calculated (%): H: 6.30, C: 59.54, N: 5.34. Found (%): H: 6.34, C: 59.55, N: 5.02.

SYNTHESIS EXAMPLE 2

Synthesis of Coupler (2)

Using the 4-equivalent coupler 1-(2,4,6-trichlorophenyl)-3-(2-chloro-5-tetradecanamidoanilino)-5-pyrazolone and Intermediate C synthesized in Synthesis Example 1, Coupler (2) having a melting point of 162° to 165° C. was obtained in a yield of 60.3% in an analogous manner as described in Synthesis Example 1.

Elemental Analysis: Calculated (%): H: 6.53, C: 57.73, N: 5.85. Found (%): H: 6.52, C: 57.69, N: 5.90.

SYNTHESIS EXAMPLE 3

Synthesis of Coupler (25)

Coupler (25) was synthesized using the reaction scheme as illustrated below.

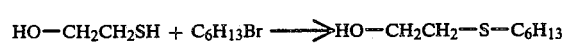

Intermediate D

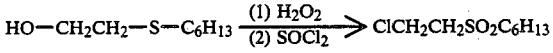

Intermediate E

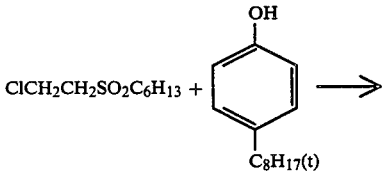

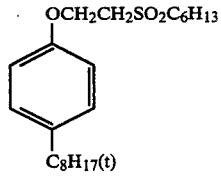

Intermediate F

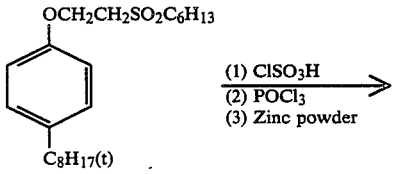

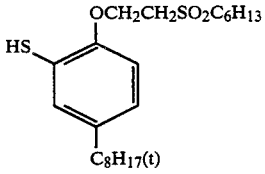

Intermediate G

-continued

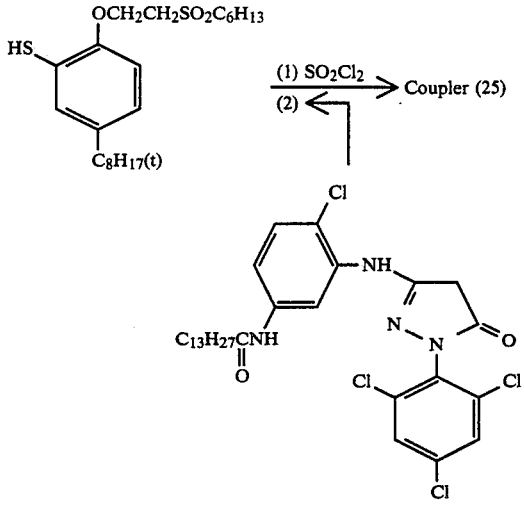

Step (1): Synthesis of Intermediate D 156 g (2.0 mol) of 2-mercaptoethanol was dissolved in 400 ml of methanol, to the solution was added 442.2 ml of a 28% methanol solution of sodium methylate (SM-28) under nitrogen atmosphere and the mixture was heated at 90° C. with stirring. 363 g (2.2 mol) of hexyl bromide was added to the mixture and the mixture was stirred at the same temperature for 2 hours. The reaction mixture was cooled and acetic acid was added thereto to adjust the mixture to a pH of 5 to 6. 1,000 ml of ethyl acetate was then added, and extraction conducted, followed by washing repeatedly with water. The ethyl acetate layer was dried with anhydrous sodium sulfate and the solvent was removed. The oily residue was then distilled under reduced pressure to obtain 282 g (yield: 87.0%) of the fraction having a boiling point of 128° to 132° C./16 mm Hg.

Step (2): Synthesis of Intermediate E

A mixture of 233 g of Intermediate D described above, 400 ml of ethanol, 400 ml of water and 5 g of $Na_2WO_4.2H_2O$ as a catalyst was stirred at room temperature, and to the mixture was gradually added dropwise 280 g of a 30% aqueous hydrogen peroxide. The temperature of the reaction mixture rose to 70° C. with the progress of the dropwise addition. The mixture was further reacted at 80° C. for 2 hours. After cooling, 500 ml of water was added to the mixture, followed by thorough stirring. The crystals thus-deposited were collected by filtration, washed with water and dried. The weight of the crystals after drying was 215 g (yield: 77.1%).

200 g of the crystals thus-obtained were dissolved in a solvent mixture of 100 ml of pyridine and 1,000 ml of benzene and the solution was stirred at room temperature. To the solution 87.6 ml of thionyl chloride was added dropwise and the mixture was heated at 50° to 55° C. with stirring. After cooling, 1,500 ml of ethyl acetate was added to the reaction mixture, and the ethyl acetate layer was repeatedly washed with water and a saturated aqueous sodium hydrogen carbonate solution, and dried with anhydrous sodium sulfate. After drying, the solvent was distilled off to obtain 218 g of Intermediate E as an almost pure oily product.

Step (3): Synthesis of Intermediate F

A mixture of 136 g of tert-octylphenol, 138 g of anhydrous potassium carbonate, 65 ml of polyethylene glycol 400 and 650 ml of acetonitrile was heated at 50° C. with stirring. To the mixture 218 g of Intermediate E described above was gradually added dropwise and the mixture was refluxed by heating for 7 hours. After cooling, the inorganic substance was removed by filtration. The filtrate was concentrated under reduced pressure to one half of the original volume and cooled with ice. The crystals thus-deposited were collected by filtration and dried to obtain 130 g of Intermediate F as colorless crystals having a melting point of 81° to 82° C.

Step (4): Synthesis of Intermediate G 130 g of Intermediate F described above was dissolved in 200 ml of methylene chloride, the solution was cooled at 0° C. with stirring to which was added dropwise 30.1 ml of chlorosulfonic acid and the mixture was stirred at 5° C. for 1 hour. To the mixture were added in order 50 ml of acetonitrile, 150 ml dimethylacetamide and 62.5 ml of phosphorus oxychloride and the mixture was stirred at 40° C. for 1 hour. After the completion of the reaction, the reaction mixture was poured into a mixture of 48 ml of concentrated sulfuric acid and 200 g of ice and vigorously stirred. To the mixture was added 75 g of zinc powder divided into several parts while maintaining the inner temperature below 10° C. After completion of the addition, the mixture was heated at a temperature of 50° to 60° C. for 1.5 hours with stirring. Ethyl acetate was added to the reaction mixture and extraction conducted. The ethyl acetate layer was washed with water and concentrated and the residue was crystallized from a mixture of methanol and water (5/1 by volume) to obtain 100 g of Intermediate G having a melting point of 52° to 53° C.

Step (5): Synthesis of Coupler (25)

In an analogous manner to that described in Synthesis Example 1, 21.7 g of Intermediate G described above was transferred into sulfenyl chloride, and then was reacted with 30.7 g of 1-(2,4,6-trichlorophenyl)-3-(2-chloro-5-tetradecanamidoanilino)-5-pyrazolone to obtain 28 g of Coupler (25) having a melting point of 155° to 157° C.

Elemental Analysis: Calculated (%): H: 7.02, C: 59.65, N: 5.46. Found (%): H: 7.06, C: 59.69, N: 5.36.

SYNTHESIS EXAMPLE 4

Synthesis of Coupler (34)

20 g of 2-(2-methanesulfonamidoethyloxy)-5-tert-octylthiophenol (having a melting point of 79° to 80° C.) synthesized by the same method as described in Synthesis Example 1 or 3, which corresponds to a splitting-off group, was dissolved in 30 ml of methylene chloride, and to the solution was added 4.48 ml of sulfonyl chloride while stirring at room temperature, after which the mixture was stirred further for 30 minutes. The red-orange colored oily product obtained by removing the solvent was added to 150 ml of a dimethylformamide solution containing 32.6 g of 1-(2,4,6-trichlorophenyl)-3-(2-chloro-5-tetradecanamidoanilino)-5-pyrazolone, and the mixture was heated at 50° C. for 2 hours with stirring. After the completion of the reaction, the reaction mixture was extracted with ethyl acetate, washed with water, concentrated and crystallized from a solvent mixture of hexane and ethyl acetate (5:1 by volume) to obtain 10 g of Coupler (34) having a melting point of 113° to 116° C.

Elemental Analysis: Calculated (%): H: 6.49, C: 56.85, N: 7.21. Found (%): H: 6.38, C: 56.36, N: 6.96.

SYNTHESIS EXAMPLE 5

Other representative couplers according to the present invention were synthesized in an analogous manner to that described in Synthesis Examples 1 to 4. The melting points thereof are set forth below.

Coupler (4): 135° to 138° C.

Coupler (5): 216° to 217° C.

Coupler (7): 129° to 132° C.

Couplers which can be employed in the present invention in addition to the couplers according to the present invention include dye forming couplers as described below, that is, compounds capable of color forming upon oxidative coupling with an aromatic primary amine developing agent (e.g., phenylenediamine derivatives, aminophenol derivatives, etc.) in color development processing. More specifically, suitable examples of magenta couplers which can be used include conventional 5-pyrazolone couplers, pyrazolobenzimidazole couplers, cyanoacetylcumarone couplers, open-chain acylacetonitrile couplers, etc. Suitable examples of yellow color image-forming couplers ("yellow couplers") which can be used include acylacetamide couplers (e.g., benzoylacetanilides, pivaloylacetanilides, etc.), etc. Suitable examples of cyan color image-forming couplers ("cyan couplers") which can be used include naphthol couplers, phenol couplers, etc. Among these couplers, those which are nondiffusible by means of containing a hydrophobic group referred to as a ballast group in the molecule thereof, or polymeric couplers, are preferably employed. These couplers may be either 4-equivalent or 2-equivalent per silver ion. Further, colored couplers having a color correction effect, or couplers capable of releasing a development inhibitor with the advance of development (the so-called DIR couplers) can be employed.

Furthermore, non-color forming DIR coupling compounds which can provide colorless products upon coupling reaction and release development inhibitors can be employed other than DIR couplers.

Two or more kinds of the above-described couplers and the like can be incorporated together in the same layer for the purpose of satisfying characteristics required to the light-sensitive material, or the same coupler compound may be added to two or more layers, depending upon the particular characteristics desired.

In order to incorporate the coupler into a silver halide emulsion layer, known methods, e.g., the method as described in U.S. Pat. No. 2,322,027, etc., can be employed. Specifically, the coupler is dissolved in an organic solvent having a high boiling point (more than 150° C.), for example, phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octylbenzoate, etc.), alkylamides (e.g., diethyllaurylamide, etc.), fatty acid esters (e.g., dibutoxyethyl succinate, diethyl azelate, etc.), trimesic acid esters (e.g., tributyl trimesate, etc.), etc., or in an organic solvent having a low boiling point of about 30° C. to 150° C., for example, lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, etc., and then the solution is dispersed into a hydrophilic colloid. The above-described organic solvents having a high boiling point and above-described organic solvents having a low boiling point may be used together as mixtures.

Furthermore, dispersing methods utilizing a polymeric material, e.g., as described in Japanese Patent Publication No. 39853/76 and Japanese Patent Application (OPI) No. 59943/76 can also be employed.

When the coupler contains an acid group such as a carboxylic acid group, a sulfonic acid group, etc., it is incorporated into a hydrophilic colloid in the form of an alkaline aqueous solution.

It is advantageous to select photographic color couplers to be used so as to provide images of medium scale. It is preferred that cyan dyes formed from cyan couplers exhibit their maximum absorption bands in the wavelength range from about 600 nm to 720 nm, magenta dyes formed from magenta couplers exhibit their maximum absorptfon bands in the wavelength range from about 500 nm 580 nm, and yellow dyes formed from yellow couplers exhibit their maximum absorption bands in the wavelength range from about 400 nm to 480 nm.

The light-sensitive material prepared using the present invention may contain, as a color fog preventing agent, hydroquinone derivatives, aminophenol derivatives, gallic acid derivatives, ascorbic acid derivatives and the like. Specific examples of the color fog preventing agent which can be used include those described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, etc. Further, in the photographic light-sensitive material containing the couplers according to the present invention, the color fog preventing agents as described in Japanese Patent Application (OPI) Nos. 102231/83 and 105147/83, Japanese Patent Application (OPI) No. 126530/83 and Japanese Patent Application No. 92082/83 (corresponding to U.S. patent application Ser. No. 614,091, filed on May 25, 1984 and European Patent Application No. 84 106 000.7, filed on May 25, 1984) are particularly effectively used.

The light-sensitive material prepared using the present invention may contain an ultraviolet ray absorbing agent in a hydrophilic colloid layer thereof. Suitable examples of such an ultraviolet ray absorbing agent include benzotriazole compounds substituted with an aryl group (e.g., those described in U.S. Pat. No. 3,533,794, etc.), 4-thiazolidone compounds (e.g., those described in U.S. Pat. Nos. 3,314,794 and 3,352,681, etc.), benzophenone compounds (e.g., those described in Japanese Patent Application (OPI) No. 2784/71, etc.), cinnamic acid ester compounds (e.g., those described in U.S. Pat. Nos. 3,705,805 and 3,707,375, etc.), butadiene compounds (e.g., those described in U.S. Pat. No. 4,045,229, etc.), benzoxazole compounds (e.g., those described in U.S. Pat. No. 3,700,455, etc.), etc. In addition, those described in U.S. Pat. No. 3,499,762 and those described in Japanese Patent Application (OPI) No. 48535/79 can also be employed. Further, couplers which have ultraviolet ray absorbing abilities (e.g., α-naphthol type cyan dye forming couplers, etc.) and polymers which have ultraviolet ray absorbing abilities may be employed. These ultraviolet ray absorbing agents may be mordanted in a specific layer(s).

The light-sensitive material prepared using the present invention may contain a water-soluble dye in a hydrophilic colloid layer thereof as a filter dye or for the purpose of preventing irradiation or other various purposes. Suitable examples of such a dye include oxonol dyes, hemioxonol dyes, styryl dyes, merocyanine dyes, cyanine dyes and azo dyes, etc. Of these dyes, oxonol dyes, hemioxonol dyes and merocyanine dyes are useful. Specific examples of the dye which can be used include those described in British Pat. Nos. 584,609 and 1,177,429, Japanese Patent Application (OPI) Nos. 85130/73, 99620/74, 114420/74 and 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352, etc.

The photographic emulsion which can be used in the present invention may be spectrally sensitized with methine dyes or other dyes. Suitable dyes which can be used include cyanine dyes, merocyanine dyes, complex cyanine dyes, complex merocyanine dyes, holopolar cyanine dyes, hemicyanine dyes, styryl dyes and hemioxonol dyes. Of these dyes, especially useful dyes are those belonging to cyanine dyes, merocyanine dyes or complex merocyanine dyes. Any nucleus which is conventionally used in cyanine dyes as a basic heterocyclic nucleus is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nuclues, etc., are appropriate. The carbon atoms of these nuclei can also be substituted.

The merocyanine dyes and the complex merocyanine dyes can contain 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., as a nucleus having a ketomethylene structure.

Specific examples of useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, etc.

These sensitizing dyes can be employed individually or in combination. Combinations of sensitizing dyes are often employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dye can be used in the emulsion together with dyes which themselves do not have a spectrally sensitizing function but exhibit a supersensitizing effect, or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721, etc.), aromatic organic acid-formaldehyde condensates (e.g., those described in U.S. Pat. No. 3,743,510, etc.), cadmium salts, azaindene compounds, etc., can be used. Particularly useful combinations are those disclosed in U.S. Pat. Nos. 3,615,613, 3,615,641, 3,617,295 and 3,635,721.

Photographic processing of the light-sensitive material according to the present invention can be carried out using any of known methods. Further, known processing solutions can be used. The processing temperature is generally selected from a range of 18° C. to 50° C., but temperatures lower than 18° C. or higher than 50° C. may be employed. Either a development processing for forming silver images (black-and-white photographic processing) or a color photographic processing comprising a development processing for forming dye images may be employed depending upon the purpose.

A color developing solution is generally an alkaline aqueous solution containing a color developing agent. As a color developing agent, known primary aromatic amine developing agents such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-$\beta$-hydroxyethylaniline, 3-methyl-4-amino-N-ethyl-$\beta$-methanesulfonamidoethylaniline, 4-amino-3-methyl-N-ethyl-N-$\beta$-methoxyethylaniline, etc.) can be used.

In addition, those described in L. F. A. Mason, *Photographic Processing Chemistry,* pages 226 to 229, Focal Press (1966), U.S. Pat. Nos. 2,193,015 and 2,592,364, Japanese Patent Application (OPI) No. 64933/73, etc., can be used.

The color developing solution can also contain pH buffering agents such as sulfites, carbonates, borates, phosphates of alkali metals, etc.; development restrainers or antifogging agents such as bromides, iodides, organic antifogging agents, etc. In addition, if desired, the color developing solution may contain water softeners; preservatives such as hydroxyamine, etc.; organic solvents such as benzyl alcohol, diethylene glycol, etc.; development accelerators such as polyethylene glycol, quaternary ammonium salts, amines, etc.; dye forming couplers; competing couplers; fogging agents such as sodium borohydride, etc.; auxiliary developing agents such as 1-phenyl-3-pyrazolidone; viscosity imparting agents; chelating agents of polycarboxylic acid type as described in U.S. Pat. No. 4,083,723; antioxidants as described in West German Patent Application (OLS) No. 2,622,950; etc.

After color development, the photographic emulsion layers are generally subjected to a bleach processing. Bleach processing can be carried out simultaneously with fixing or separately therefrom. Suitable examples of the bleaching agents which can be used include compounds of polyvalent metals such as iron (III), cobalt (III), chromium (IV), copper (II), etc., peracids, quinones, nitroso compounds, etc. Specific examples include ferricyanides; bichromates; organic complex salts of iron (III) or cobalt (III) with aminopolycarboxylic acids such as ethylenediaminetetraacetic acid, nitrilotriacetic acid, 1,3-diamino-2-propanoltetraacetic acid, etc., or organic acids such as citric acid, tartaric acid, malic acid, etc.; persulfates; permanganates; nitrosophenol, etc. Of these compounds, potassium ferricyanide, sodium ethylenediaminetetraacetato iron (III), and ammonium ethylenediaminetetraacetato iron (III) are particularly useful. Ethylenediaminetetraacetato iron (III) complex salts are useful both in a bleaching solution and in a mono-bath bleach-fixing solution.

To a bleaching solution or a bleach-fixing solution, bleaching accelerators as described in U.S. Pat. Nos. 3,042,520 and 3,241,966, Japanese Patent Publication Nos. 8506/70 and 8836/70, etc.; thiol compounds as described in Japanese Patent Application (OPI) No. 65732/78, and other various additives can be added.

The silver halide emulsion used in the present invention is prepared generally by mixing a solution of a water-soluble silver salt (e.g., silver nitrate) with a solution of a water-soluble halide (e.g., potassium bromide) in the presence of a solution of a water-soluble polymer (e.g., gelatin). Silver halide which can be used includes not only silver chloride and silver bromide, but also mixed silver halide such as silver chlorobromide, silver iodobromide, silver chloroiodobromide, etc. A mean grain size of silver halide grains produced (the grain size refers to the diameter of a grain when it is spherical or similar spherical in the shape, or the edge length when it is cubic, and the mean grain size is determined on the basis of the projected areas) is preferably 2$\mu$ or less, and more preferably 0.4$\mu$ or less. The distribution of the grain size can be either narrow or broad.

Further, for the purpose of preventing contamination of developing solution or accelerating development, etc., substantially light-insensitive fine grain silver halide emulsion may be incorporated into a light-sensitive layer, an intermediate layer, a protective layer, etc.

These silver halide grains may have a crystal form of cube, a crystal form of an octahedron, a composite form thereof, etc.

Further, a silver halide emulsion in which at least 50% of the total projected area of the silver halide grains is tabular silver halide grains (for example, tabular silver halide grains having a length-to-thickness ratio of 5 or more, and preferably 8 or more) may be employed.

Also, two or more silver halide photographic emulsions which are produced separately may be used in the form of mixture. Further, silver halide grains having a uniform crystal structure, silver halide grains in which the inner portion and the outer portion have different layer structures, or silver halide grains of the so-called conversion type as described in British Pat. No. 635,841, U.S. Pat. No. 3,622,318, etc., may be employed. Moreover, either silver halide grains in which a latent image is predominantly formed at the surface thereof or grains in which a latent image is predominantly formed inner portion thereof can be used. Such photographic emulsions are described in C. E. K. Mees, *The Theory of the Photographic Process,* Macmillan Co., P. Glafkides, *Chimie Photographique,* Paul Montel Co. (1957), etc. These photographic emulsions can be prepared using the methods as described, e.g., in P. Glafkides, *Chimie et Physique Photographique,* Paul Montel Co. (1967), G. F. Duffin, *Photographic Emulsion Chemistry,* The Focal Press (1966), V. L. Zelikman et al., *Making and Coating Photographic Emulsion,* The Focal Press (1966), etc. Namely, any of an acidic process, a neutral process, or an ammonia process, may be used for the preparation of the photographic emulsions. Suitable methods for reacting a water-soluble silver salt with a water-soluble halide include, e.g., a single jet method, a double jet method, or a combination thereof.

Also, a method in which silver halide grains are formed in the presence of an excess of silver ions (the so-called reversal mixing method) can be employed in the present invention. Further, the so-called controlled double jet method, in which the pAg in a liquid phase wherein silver halide grains are formed is maintained at a constant value, may be also employed. According to this method, a silver halide emulsion having a regular crystal form and substantially uniform grain sizes can be obtained.

A mixture of two or more kinds of silver halide emulsions prepared separately may be employed.

In a process of forming silver halide grains and physical ripening thereof, cadmium salts, zinc salts, lead salts, thallium salts, iridium salts or complex salts thereof, rhodium salts or complex salts thereof, iron salts or complex salts thereof, etc., may be present.

Removal of the soluble salts from the silver halide emulsion is, in general, carried out after the formation of the silver halide grains or after physical ripening. The removal can be effected using the noodle washing method which has been known from old times and comprises gelling the gelatin, or using a flocculation process using a polyvalent anion-containing inorganic salt (e.g., sodium sulfate, etc.), an anionic surface active agent, an anionic polymer (e.g., polystyrenesulfonic acid, etc.), or a gelatin derivative (e.g., an aliphatic acylated gelatin, an aromatic acylated gelatin, an aromatic carbamoylated gelatin, etc.). The removal of the soluble salts from the silver halide emulsion may be omitted.

The silver halide emulsion used in the present invention can be the so-called primitive emulsion without application of chemical sensitization. However, it is usually chemically sensitized. Chemical sensitization can be carried out using the methods as described in P. Glafkides, supra, V. L. Zelikman et al., supra, or H. Frieser, *Die Grundlagen der Photographischen Prozesse mit Silberhalogeniden,* Akademische Verlagsgesellschaft (1968).

The photographic emulsion layers and other hydrophilic colloid layers which constitute the light-sensitive material according to the present invention may contain various kinds of surface active agents as coating aids or for other various purposes, for example, prevention of charging, improvement of slipping property, emulsifying dispersion, prevention of adhesion, improvement of photographic characteristics (e.g., acceleration of development, high contrast, sensitization, etc.), etc.

Examples of suitable surface active agents include nonionic surface active agents, for example, saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicones, etc.), glycidol derivatives (e.g., alkenylsuccinic acid polyglycerides, alkylphenol polyglycerides, etc.), fatty acid esters of polyhydric alcohols, alkyl esters of sugar, etc.; anionic surface active agents containing acidic groups such as a carboxy group, a sulfo group, a phospho group, a sulfuric acid ester group, a phosphoric acid group, etc., for example, alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surface active agents, for example, amino acids, aminoalkylsulfonic acids, aminoalkylsulfuric acid esters, aminoalkylphosphoric acid esters, alkylbetaines, amine oxides, etc.; and cationic surface active agents, for example, alkylamine salts, aliphatic or aromatic quaternary ammonium salts, heterocyclic quaternary ammonium salts (e.g., pyridinium, imidazolium, etc.), aliphatic or heterocyclic phosphonium or sulfonium salts, etc.

The present invention will be explained in greater detail with reference to the following examples, but the present invention should not be construed as being limited thereto.

EXAMPLE 1

0.008 mol of Magenta Coupler (1) according to the present invention was dissolved in a mixture of 20 ml of tricresyl phosphate and 20 ml of ethyl acetate. The resulting solution was added to a 10% aqueous gelatin solution containing 0.4 g of sodium dodecylbenzenesulfonate, and the mixture was stirred and dispersed by means of a homogenizer rotating at a high speed to prepare a dispersion. The dispersion thus-prepared was mixed with 150 g of a silver chlorobromide emulsion (containing 8.8 g of silver, and having a bromide content of 50 mol%), and thereto were added sodium dodecylbenzenesulfonate as a coating aid and 2-oxy-4,6-dichloro-s-triazine as a hardener. The mixture was coated on a paper support both surfaces of which were laminated with polyethylene at a silver coated amount of 0.165 g/m$^2$ to form an emulsion layer. Further, a gelatin protective layer was coated on the emulsion layer to prepare Sample 1.

Samples 2 to 5 were prepared in the same manner as described in Sample 1 except using Magenta Couplers (2), (4), (7) and (25) according to the present invention in place of Magenta Coupler (1), respectively. Furthermore, for comparison, Samples 6 to 8 were prepared in the same manner as described in Sample 1 except using Magenta Couplers (A), (B) and (C) which are outside of the scope of the present invention in place of Magenta Coupler (1), respectively.

Comparative Magenta Coupler (A)

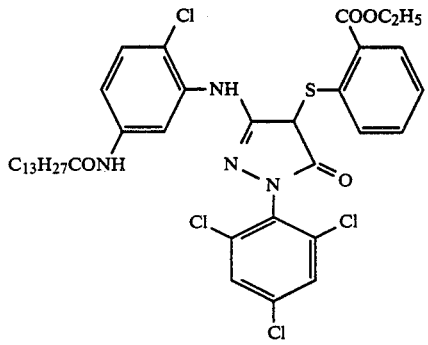

Comparative Magenta Coupler (B)

-continued

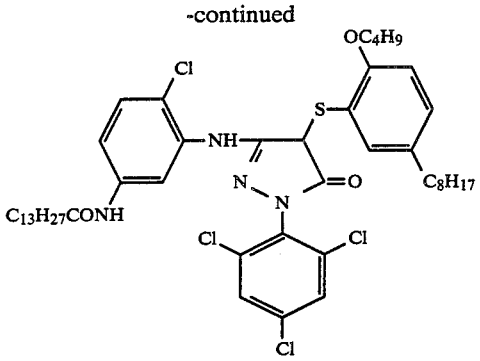

Comparative Magenta Coupler (C)

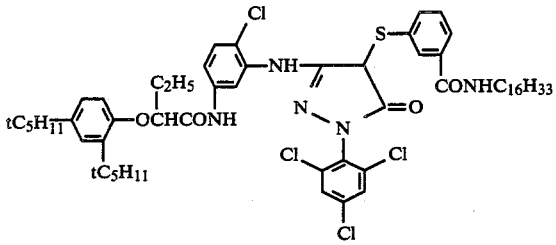

These samples were exposed stepwise to light and subjected to the following processing steps.

| Processing Step | Temperature (°C.) | Time |
|---|---|---|
| 1. Color Development | 33 | 3 min 30 sec |
| 2. Bleach-Fixing | 33 | 1 min 30 sec |
| 3. Washing | 28 to 35 | 3 min |
| 4. Drying | | |

Two kinds of color developing solutions illustrated below were employed.

| | Color Developing Solution | |
|---|---|---|
| | A | B |
| Distilled Water | 800 ml | 800 ml |
| Triethanolamine | 11.0 ml | 11.0 ml |
| Diethylene Glycol | 0.2 ml | 0.2 ml |
| Benzyl Alcohol | 14.0 ml | 14.0 ml |
| Lithium Chloride | 2.1 g | 2.1 g |
| Potassium Bromide | 0.6 g | 0.6 g |
| Hydroxylamine Sulfate | 3.0 g | 3.0 g |
| Potassium Sulfite | 1.8 g | 1.8 g |
| Anti Ca No. 5 (manufactured) by Eastman Kodak Co.) | 0.8 ml | 0.8 ml |
| 4-Amino-3-methyl-N—ethyl-N—[β-(methanesulfonamido)-ethyl]-p-phenylenediamine | 4.25 g | 4.25 g |
| Potassium Carbonate | 28.0 g | 28.0 g |
| Calcium Nitrate | 0 g | 0.82 g |
| Distilled Water to Make | 1,000 ml (pH = 10.1) | 1,000 ml (pH = 10.1) |

The composition of the bleach-fixing solution were as follows.

| Bleach-Fixing Solution | |
|---|---|
| Ammonium Thiosulfate (70 wt %) | 150 ml |
| Sodium Sulfite | 15 g |
| Sodium Ethylenediaminetetraacetato Iron (III) | 40 g |
| Ethylenediaminetetraacetic Acid | 4 g |

-continued

| Bleach-Fixing Solution | |
|---|---|
| Water to make | 1,000 ml (pH = 6.9) |

The green-light reflective densities of the magenta dye images thus-obtained were measured and the maximum densities ($D_{max}$) were determined. The results are shown in Table 1 below.

TABLE 1

| Sample No. | Magenta Coupler | $D_{max}$ Color Developing Solution A | $D_{max}$ Color Developing Solution B |
|---|---|---|---|
| 1 | (1) (Invention) | 2.45 | 2.43 |
| 2 | (2) (Invention) | 2.42 | 2.44 |
| 3 | (4) (Invention) | 2.43 | 2.42 |
| 4 | (7) (Invention) | 2.46 | 2.45 |
| 5 | (15) (Invention) | 2.45 | 2.44 |
| 6 | (A) (Comparison) | 2.23 | 1.52 |
| 7 | (B) (Comparison) | 2.44 | 1.73 |
| 8 | (C) (Comparison) | 2.15 | 1.68 |

It is apparent from the results shown in Table 1 above that Samples 1 to 5 containing the magenta couplers according to the present invention exhibit the same color forming properties both with Color Developing Solution A which does not containing calcium nitrate and with Color Developing Solution B containing calcium nitrate. On the contrary, it is recognized that the color forming properties of Samples 6 to 8 containing the comparative magenta couplers are remarkably decreased when they are processed in Color Developing Solution B.

EXAMPLE 2

On a paper support both surfaces of which were laminated with polyethylene were coated a first layer to a sixth layer as shown in Table 2 below to prepare Sample 9. In Table 2 below the coating amounts are set forth in mg/m$^2$.

TABLE 2

| | |
|---|---|
| Sixth Layer: (protective layer) | Gelatin (1,000 mg/m$^2$) |
| Fifth Layer: (red-sensitive layer) | Silver chlorobromide emulsion (Br: 50 mol %; silver: 300 mg/m$^2$), Gelatin (1,000 mg/m$^2$), Cyan coupler*1 (400 mg/m$^2$), Coupler solvent*2 (200 mg/m$^2$) |
| Fourth Layer: (interlayer) | Gelatin (1,200 mg/m$^2$), Ultraviolet light-absorbing agent*3 (1,000 mg/m$^2$), Ultraviolet light-absorbing agent solvent*2 (250 mg/m$^2$) |
| Third Layer: (green-sensitive layer) | Silver chlorobromide emulsion (Br: 50 mol %; silver: 330 mg/m$^2$), Gelatin (1,000 mg/m$^2$), Magenta coupler*4 (375 mg/m$^2$), Coupler solvent*5 (750 mg/m$^2$) |
| Second Layer: (interlayer) | Gelatin (1,000 mg/m$^2$) |
| First Layer: (blue-sensitive layer) | Silver chlorobromide emulsion (Br: 80 mol %; silver: 400 mg/m$^2$), Gelatin (1,200 mg/m$^2$), Yellow coupler*6 (300 mg/m$^2$), Coupler solvent*7 (150 mg/m$^2$) |
| Support: | Paper support both surfaces of which |

TABLE 2-continued

| |
|---|
| were laminated with polyethylene |

*1Coupler: 2-[α-(2,4-Di-tert-pentylphenoxy)butanamido]-4,6-dichloro-5-methylphenol
*2Solvent: Dibutyl phthalate
*3Ultraviolet Light-Absorbing Agent: 2-(2-Hydroxy-3-sec-butyl-5-tert-butylphenyl)benzotriazole
*4Coupler: 1-(2,4,6-Trichlorophenyl)-3-(2-chloro-5-tetradecanamido)anilino-2-pyrazolin-5-one (Comparative Magenta Coupler (D))
*5Solvent: Tricresyl phosphate
*6Coupler: α-Pivaloyl-α-(2,4-dioxo-5,5'dimethyl-oxazolidin-3-yl)-2-chloro-5-[α-(2,4-di-tert-pentylphenoxy)butanamido]acetanilide
*7Solvent: Dibutyl phthalate A coating solution for the first layer was prepared in the following manner. That is, 100 g of the yellow coupler shown in Table 2 above was dissolved in a mixture of 50 ml of dibutyl phthalate and 100 ml of ethyl acetate. The resulting solution was dispersed in 800 g of a 10% aqueous gelatin solution containing 80 ml of a 1% aqueous solution of sodium dodecylbenzenesulfonate. The dispersion thus-prepared was mixed with 2.9 kg of a blue-sensitive silver chlorobromide emulsion (containing 133 g of silver and having a bromide content of 80 mol%) to prepare the coating solution. Coating solutions for other layers were prepared in the same manner as described for the first layer. As a hardener, sodium 2-oxy-4,6-dichloro-s-triazine was used in each layer.

Further, Samples 10 to 16 were prepared in the same manner as described in Sample 9 except that, in the third layer, the amount of silver coated was changed to 165 mg/m$^2$ and the kind of the magenta coupler and the coupler coated amount were changed as shown in Table 3 below.

These samples were exposed stepwise using a green filter, SP-2 (manufactured by Fuji Photo Film Co., Ltd.) and then subjected to the same processing as described in Example 1 (using Color Developing Solutions A and B). The green-light reflective densities of the magenta dye images thus-obtained were measured and the maximum densities ($D_{max}$) were determined. The results are shown in Table 3 below.

TABLE 3

| Sample No. | Coupler | Coated Amount of Coupler (mg/m$^2$) | $D_{max}$ Color Developing Solution A | $D_{max}$ Color Developing Solution B |
|---|---|---|---|---|
| 9 | (D)(Comparison) | 300 | 2.32 | 2.33 |
| 10 | (2)(Invention) | 287 | 2.46 | 2.45 |
| 11 | (4)(Invention) | 335 | 2.42 | 2.43 |
| 12 | (10)(Invention) | 340 | 2.43 | 2.42 |
| 13 | (34)(Invention) | 291 | 2.45 | 2.44 |
| 14 | (A)(Comparison) | 238 | 2.21 | 1.33 |
| 15 | (B)(Comparison) | 271 | 2.36 | 1.51 |
| 16 | (C)(Comparison) | 322 | 2.18 | 1.48 |

Comparative Magenta Coupler (D)

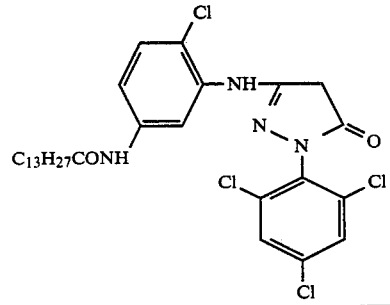

It is apparent from the results shown in Table 3 above that Samples 10 to 13 containing the magenta couplers according to the present invention exhibit excellent color forming properties in comparison with Sample 9 containing the comparative 4-equivalent Magenta Coupler (D) in spite of reducing the coated amount of silver in Samples 10 to 13 to one half of that in Sample 9. Further, it is also apparent that the decrease in color forming property is not observed in Samples 10 to 13 in comparison with Samples 14 to 16 containing the comparative arylthio-releasing type 2-equivalent Magenta Couplers (A), (B) and (C), respectively, even when they are processed using Color Developing Solution B containing calcium nitrate.

Furthermore, the samples processed in the same manner as described above using Color Developing Solution A were subjected to a fading test for 5 days using a xenon fading tester (200,000 lux). The results obtained are shown in Table 4 below.

TABLE 4

| Sample No. | Coupler in the Third Layer | Xenon Irradiation for 5 Days: Magenta Density at Area Having Initial Density of 1.0 | Xenon Irradiation for 5 Days: Yellow Stain Density in White Background |
|---|---|---|---|
| 9 | (D) (Comparison) | 0.52 | 0.46 |
| 10 | (2) (Invention) | 0.81 | 0.28 |
| 11 | (4) (Invention) | 0.78 | 0.27 |
| 12 | (10) (Invention) | 0.95 | 0.26 |
| 13 | (34) (Invention) | 0.84 | 0.28 |
| 14 | (A) (Comparison) | 0.62 | 0.35 |
| 15 | (B) (Comparison) | 0.77 | 0.28 |
| 16 | (C) (Comparison) | 0.50 | 0.45 |

It is apparent from the results shown in Table 4 above that Samples 10 to 13 containing the magenta couplers according to the present invention have an excellent light-fastness in that the decrease in the magenta color density and the yellow coloration of the white background due to the xenon irradiation are small in comparison with Samples 9 and 14 to 16 containing the comparative couplers.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having coated thereon at least one silver halide emulsion layer, the color photographic light-sensitive material having a photographic layer containing at least one kind of magenta coupler of 5-pyrazolone type having an arylthio group at the coupling position thereof, the arylthio group having an alkoxy group or an aryloxy group at the ortho position to the sulfur atom thereof and the alkoxy group and the aryloxy group being substituted with a cyano group, a halogen atom, a sulfonyl group, a sulfinyl group, a phosphonyl group, or an

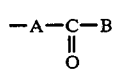

group, wherein A represents a chemical bond, an alkylene group, an arylene group, an oxygen atom, a sulfur atom, or an imino group; and B represents a hydroxy group, an alkoxy group, an aryloxy group, a hydrogen atom, an alkyl group, an aryl group, an acyclic amino group, or a hydrazino group; or wherein A and B are bonded to each other to form a ring together with

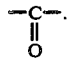

2. A silver halide color photographic light-sensitive material as in claim 1, wherein the magenta coupler of the 5-pyrazolone type is a compound represented by formula (I)

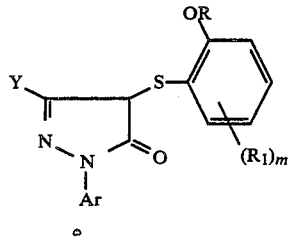

(I)

wherein Ar represents a phenyl group substituted with at least one halogen atom, an alkyl group, an alkoxy group, an alkoxycarbonyl group or a cyano group; R represents an alkyl group or an aryl group each being substituted with a cyano group, a halogen atom, a sulfonyl group, a sulfinyl group, a phosphonyl group, or an

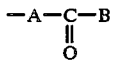

group, wherein A and B each has the same meaning as defined in claim 1; $R_1$ represents a hydrogen atom, a halogen atom, a hydroxy group, an alkyl group, an alkoxy group, an aryl group, an amino group, an acylamino group, an alkylureido group, an alkoxycarbonylamino group, an imido group, a sulfonamido group, a sulfamoyl group, a sulfamoylamino group, a nitro group, an alkoxycarbonyl group, a carbamoyl group, an acyl group, a cyano group, or an alkylthio group, Y represents an acylamino group or an anilino group, m represents an integer of from 1 to 4 and when m is 2 or more, the $R_1$'s may be the same or different.

3. A silver halide color photographic light-sensitive material as in claim 1, wherein the magenta coupler of the 5-pyrazolone type is a compound represented by formula (I)

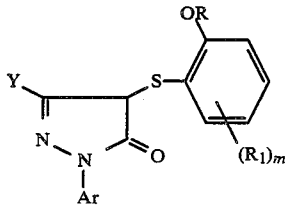

(I)

wherein Ar represents a phenyl group substituted with at least one halogen atom, an alkyl group, an alkoxy group, an alkoxycarbonyl group or a cyano group; R represents an alkyl group or an aryl group each being substituted with a cyano group, a halogen atom, a sulfonyl group, a sulfinyl group, a phosphonyl group, or an

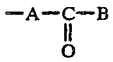

group, wherein A and B each has the same meaning as defined in claim 1 or a divalent group connected to another coupler skeleton; $R_1$ represents a hydrogen atom, a halogen atom, a hydroxy group, an alkyl group, an alkoxy group, an aryl group, an amino group, an acylamino group, an alkylureido group, an alkoxycarbonylamino group, an imido group, a sulfonamido group, a sulfamoyl group, a sulfamoylamino group, a nitro group, an alkoxycarbonyl group, a carbamoyl group, an acyl group, a cyano group, an alkylthio group, or a divalent group connected to another coupler skeleton; Y represents an acylamino group or an anilino group; m represents an integer of from 1 to 4 and when m is 2 or more, the $R_1$'s may be the same or different; provided that at least one of R or one of the $R_1$'s is a divalent group connected to another coupler skeleton.

4. A silver halide color photographic light-sensitive material as in claim 2, wherein the magenta coupler represented by formula (I) is a compound represented by formula (II)

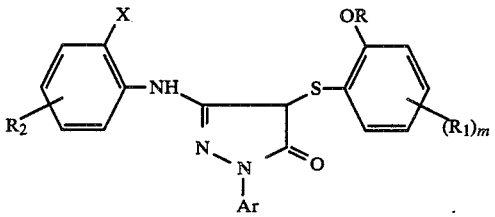

(II)

wherein R, $R_1$, m, and Ar each has the same meaning as defined in claim 2; X represents a halogen atom or an alkoxy group; and $R_2$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, or a trichloromethyl group.

5. A silver halide color photographic light-sensitive material as in claim 4, wherein Ar represents a phenyl group substituted with at least one halogen atom, an alkyl group having from 1 to 22 carbon atoms, an alkoxy group having from 1 to 22 carbon atoms, an alkoxycarbonyl group having from 2 to 23 carbon atoms or a cyano group; X represents a halogen atom or an alkoxy group having from 1 to 22 carbon atoms; and $R_2$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, or a trichloromethyl group, wherein the alkyl moiety has from 1 to 36 carbon atoms and the aryl moiety has from 6 to 38 carbon atoms.

6. A silver halide color photographic light-sensitive material as in claim 4, wherein R represents an alkyl group or an aryl group each having the substituent selected from

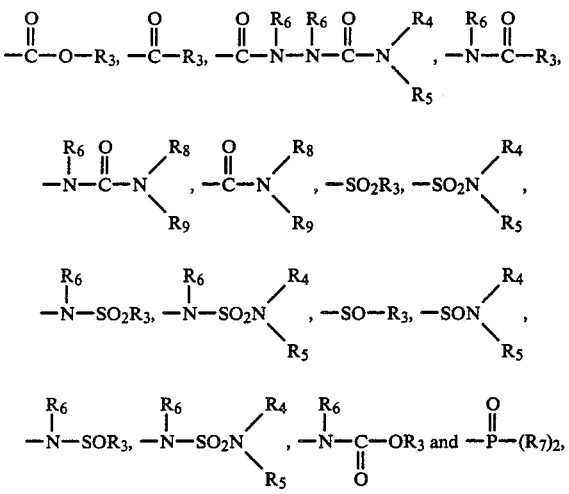

wherein $R_3$ represents a hydrogen atom, an alkyl group, or an aryl group; $R_4$ and $R_5$ independently represent a hydrogen atom, an alkyl group, an aryl group or a heterocyclic group, or may be bonded to each other to form a 5-membered, 6-membered, or 7-membered nitrogen-containing heterocyclic ring; $R_6$ represents a hydrogen atom or an alkyl group; $R_7$ represents an alkyl group, an alkoxy group, an aryl group, or an aryloxy group; and $R_8$ and $R_9$ independently represent a hydrogen atom, an alkyl group, or an aryl group.

7. A silver halide color photographic light-sensitive material as in claim 1, wherein the magenta coupler is present in a silver halide emulsion layer.

8. A silver halide color photographic light-sensitive material as in claim 7, wherein the silver halide emulsion layer is a green-sensitive silver halide emulsion layer.

9. A silver halide color photographic light-sensitive material as in claim 8, wherein the photographic material further comprises a blue-sensitive silver halide emulsion layer containing a yellow color-forming coupler and a red-sensitive silver halide emulsion layer containing a cyan color-forming coupler.

10. A method of forming a color image comprising developing with an aqueous alkaline developing solution containing a color developing agent an imagewise exposed silver halide color photographic light-sensitive material comprising a support having coated thereon at least one silver halide emulsion layer, said color photographic light-sensitive material having a photographic layer containing at least one kind of magenta coupler of 5-pyrazolone type having an arylthio group at the coupling position thereof, the arylthio group having an alkoxy group or an aryloxy group at the ortho position to the sulfur atom thereof and the alkoxy group and the aryloxy group being substituted with a cyano group, a halogen atom, a sulfonyl group, a sulfinyl group, a phosphonyl group, or an

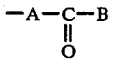

group, wherein A represents a chemical bond, an alkylene group, an arylene group, an oxygen atom, a sulfur atom, or an imino group; and B represents a hydroxy group, an alkoxy group, an aryloxy group, a hydrogen atom, an alkyl group, an aryl group, an acyclic amino group, or a hydrazino group.

11. A method of forming a color image as in claim 10, wherein the aqueous alkaline developing solution contains hard water.

12. A method of forming a color image as in claim 10, wherein the aqueous alkaline developing solution contains a salt of alkaline earth metal.

13. A method of forming a color image as in claim 10, wherein the photographic material is, after color development, processed in a bleach-fixing solution.

14. A silver halide color photographic light-sensitive material as in claim 1, wherein said magenta coupler is used in an amount of from $2\times10^{-3}$ to $5\times10^{-1}$ mol per mol of silver.

15. A silver halide color photographic light-sensitive material as in claim 2, wherein said magenta coupler is used in an amount of from $2\times10^{-3}$ to $5\times10^{-1}$ mol per mol of silver.

16. A silver halide color photographic light-sensitive material as in claim 4, wherein said magenta coupler is used in an amount of from $2\times10^{-3}$ to $5\times10^{-1}$ mol per mol of silver.

17. A silver halide color photographic light-sensitive material as in claim 10, wherein R represents an alkyl group or an aryl group each having a substituent selected from

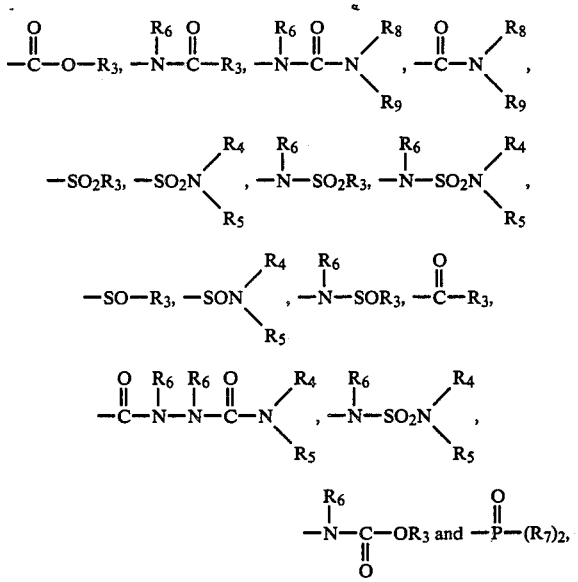

wherein $R_3$ represents a hydrogen atom, an alkyl group, or an aryl group; $R_4$ and $R_5$ independently represent a hydrogen atom, an alkyl group, an aryl group or a heterocyclic group, or may be bonded to each other to form a 5-membered, 6-membered or 7-membered nitrogen-containing heterocyclic ring; $R_6$ represents a hydrogen atom or an alkyl group; $R_7$ represents an alkyl group, an alkoxy group, an aryl group or an aryloxy group; and $R_8$ and $R_9$ independently represent a hydrogen atom, an alkyl group or an aryl group.

* * * * *